US006326115B1

(12) United States Patent
Nakanishi et al.

(10) Patent No.: US 6,326,115 B1
(45) Date of Patent: Dec. 4, 2001

(54) TONER AND TONER BINDER

(75) Inventors: Hideo Nakanishi; Hajime Fukushima, both of Kyoto (JP)

(73) Assignee: Sanyo Chemical Industries, Ltd., Kyoto-fu (JP)

( * ) Notice: Subject to any disclaimer, the term of this patent is extended or adjusted under 35 U.S.C. 154(b) by 0 days.

(21) Appl. No.: 09/530,271

(22) PCT Filed: Oct. 30, 1998

(86) PCT No.: PCT/JP98/04912

§ 371 Date: Apr. 28, 2000

§ 102(e) Date: Apr. 28, 2000

(87) PCT Pub. No.: WO99/23534

PCT Pub. Date: May 14, 1999

(30) Foreign Application Priority Data

| | | |
|---|---|---|
| Oct. 31, 1997 | (JP) | 9-315801 |
| Oct. 31, 1997 | (JP) | 9-315802 |
| Oct. 31, 1997 | (JP) | 9-315803 |
| Oct. 31, 1997 | (JP) | 9-315804 |
| Nov. 17, 1997 | (JP) | 9-333610 |
| Nov. 17, 1997 | (JP) | 9-333611 |
| Nov. 17, 1997 | (JP) | 9-333612 |

(51) Int. Cl.[7] ..... G03G 9/087
(52) U.S. Cl. ..... 430/109.5; 430/110.3
(58) Field of Search ..... 430/109.5, 109.1, 430/110.3

(56) References Cited

U.S. PATENT DOCUMENTS

| | | | | |
|---|---|---|---|---|
| 5,792,583 | * | 8/1998 | Sano et al. | 430/109 |
| 5,840,460 | * | 11/1998 | Machida et al. | 430/111 |
| 5,915,150 | * | 6/1999 | Kukimoto et al. | 430/109 |
| 6,100,000 | * | 8/2000 | Anno et al. | 430/109 |

FOREIGN PATENT DOCUMENTS

| | | |
|---|---|---|
| 57/109825A | 7/1982 | (JP) . |
| 62-70859 | 4/1987 | (JP) . |
| 63-56659 | 3/1988 | (JP) . |
| 63-174064 | 7/1988 | (JP) . |
| 4-36761 | 2/1992 | (JP) . |
| 4-78862 | 3/1992 | (JP) . |
| 4-86828 | 3/1992 | (JP) . |
| 4-110859 | 4/1992 | (JP) . |
| 6-27726 | 2/1994 | (JP) . |
| 07056390 | 3/1995 | (JP) . |
| 7-152202 | 6/1995 | (JP) . |
| 07/101318B | 11/1995 | (JP) . |
| 7-333906 | 12/1995 | (JP) . |
| 8-272141 | 10/1996 | (JP) . |
| 09015902 | 1/1997 | (JP) . |
| 09034167 | 2/1997 | (JP) . |
| 09043909 | 2/1997 | (JP) . |
| 9-43906 | 2/1997 | (JP) . |
| 10-10774 | 1/1998 | (JP) . |

* cited by examiner

*Primary Examiner*—John Goodrow
(74) *Attorney, Agent, or Firm*—Finnegan, Henderson, Farabow, Garrett & Dunner, L.L.P.

(57) ABSTRACT

A toner comprising a toner binder and a colorant, composed of resin particles produced by causing an extension reaction and/or crosslinking reaction of a dispersion formed of a reactive group-containing prepolymer (α) contained in an aqueous medium with an extension agent and/or a crosslinking agent (β). The toner has a Wadell practical sphericity of 0.90 to 1.00 and is superior in fluidity, transferability, the storage stability under heat, low temperature fixing ability and hot offset resistance.

28 Claims, No Drawings

TONER AND TONER BINDER

TECHNICAL FIELD

The present invention relates to a toner used for electrophotography, electrostatic recording and electrostatic printing and to a toner binder used in the toner and the like.

BACKGROUND ART

The toners used for electrophotography, electrostatic recording, electrostatic printing or the like are conventionally produced by fusing and kneading a toner binder such as a styrene type resin or a polyester together with a colorant, followed by pulverizing the resulting mixture.

These toners are developed on a support member such as paper and thereafter fused under heat by using a heat roll to thereby fix them. In this case, if the temperature of the heat roll is too high, the toner is fused excessively, giving rise to the problem that the toner is deposited on the heat roll (hot offset). On the other hand, if the temperature of the heat roll is excessively low, the toner is insufficiently fused, giving rise to the problem that the toner is fixed unsatisfactorily. From necessities for energy savings and the miniaturization of devices, there have been the demands for toners which produce the hot offset at higher temperatures (hot offset resistance) and have lower fixing temperature (low temperature fixing ability).

It is also required for these toners to have storage stability under heat so that they are not made into a block at the ambient temperature kept in a device during storage.

Since the glossiness of an image is demanded of the toner especially in a full color system, it is necessary for a molten toner to have low viscosity. The fulfillment of the demand results in easy production of the hot offset. To be free from the hot offset, silicon oil has been applied to the heat roll in a full color system.

Such a method of applying silicone oil to the heat roll, however, requires an oil applicator rendering the entire system complicated and large and causing the heat roll to deteriorate, requiring maintenance at intervals of a fixed period of time. Also, the oil adheres to copying papers, OHP (overhead projectors) films or the like inevitably, posing the problem of impaired color tones.

While, in recent years, there have been increasing needs of toners with a small particle size to produce a high quality image and to improve the resolution. However, because a conventional kneaded and pulverized toner has an undefined shape, it has only insufficient fluidity when it is small-sized and hence it is difficult to supply the toner to a developing unit and the transferability is impaired.

(1) Toners using, as a toner binder, a polyester which is partially crosslinked using a polyfunctional monomer (Japanese Patent Application Laid-Open (JP-A) No. S57-109825) and (2) toners using, as a toner binder, a urethane-modified polyester (Japanese Patent Publication (JP-B) No. H7-101318) are proposed as those satisfying the storage stability under heat, low temperature fixing ability and hot offset resistance among the aforementioned requirements.

(3) Toners for a full color system which are produced by granulating polyester microparticles and wax microparticles are disclosed for the purpose of reducing the amount of oil to be applied to the heat roll (JP-A No. H7-56390).

Disclosed also are (4) polymerized toners synthesized by dispersing a vinyl monomer composition containing a colorant, a polar resin and a releasing agent in water followed by suspension-polymerization (JP-A No. 9-43909) and (5) toners globed by treating a toner comprising a polyester type resin in water by using a solvent (JP-A No. 9-34167) for the purpose of improving the powder fluidity and the transferability when the toner is small-sized.

The toners (1) to (3) disclosed, however, have insufficient powder fluidity and transferability and hence never give a high quality image when they are small-sized.

The disclosed toners (1) and (2) insufficiently satisfy the storage stability under heat and the low temperature fixing ability compatibly and cannot be used in a full color system because of no development of glossiness. The disclosed toner (3) insufficiently satisfies the low temperature fixing ability and the hot offset resistance in an oilless fixing condition.

The toners (4) and (5) are found to have an effect of improving the powder fluidity and the transferability. However, the toner (4) is insufficiently improved in the low temperature fixing ability, posing the problem that the energy required for fixing is increased. Especially, full color toners offers the same problem conspicuously. The toner (5), though it is superior to the toner (4) in the low temperature fixing ability, has insufficient hot offset resistance, so that it cannot preclude the necessity of the application of oil to the heat roll in a full color system.

An object of the present invention is to provide a toner which is superior in the powder fluidity and the transferability when it is small-sized and in all of the storage stability under heat, low temperature fixing ability and hot offset resistance.

A further object of the present invention to provide a toner which has high image glossiness, when it is used, for example, in a full color copying machine, and omits the application of oil to a heat roll.

DISCLOSURE OF THE INVENTION

In order to attain the above object, earnest studies have been made and as a result, the present invention has been completed.

Accordingly the present invention involves the following three inventions:

(I) a toner comprising a toner binder and a colorant, wherein the toner has a Wadell practical sphericity of 0.90 to 1.00 and the toner binder is composed of a polyester (i) modified by a urethane bond and/or a urea bond;

(II) a toner comprising a toner binder and a colorant, wherein the toner is composed of resin particles produced by causing an extension reaction and/or crosslinking reaction of a dispersion formed of a reactive group-containing prepolymer ($\alpha$) contained in an aqueous medium by using an extension agent and/or a crosslinking agent ($\beta$); and (III) a toner binder comprising a polyester derived from a polyol (1) and a carboxylic acid (2), wherein the polyester is composed of a polyester (i) modified by a urethane bond and/or by a urea bond and a polyester (ii) modified neither by a urethane bond nor by a urea bond.

The toner and toner binder of the present invention produce the following effects.

1. They give excellent powder fluidity and superior developing ability and transferability.

2. They make it possible to obtain a toner with a small particle size with ease and exhibit high sharpness.

3. They give excellent storage stability under heat and are superior in the low temperature fixing ability and in the hot offset resistance.

4. They impart excellent glossiness and superior hot. offset resistance when they are used for color toners and hence it is unnecessary to apply oil to a fixing roll.

5. They give high transparency and an excellent color tone when they are made into color toners.

6. They are economical since they require neither kneading nor pulverization and do not need a large amount of a solvent.

BEST MODE FOR CARRYING OUT INVENTION

The present invention will be hereinafter explained in detail.

In the invention (I), the Wadell practical sphericity means the value defined by the ratio of (the diameter of a circle equivalent to the projected area of a particle)/(the diameter of a minimum circle circumscribed to the projected image of a particle) and can be measured by observing a toner particle by using an electron microscope.

The Wadell practical sphericity of the toner of the invention (I) is generally 0.90 to 1.00, preferably 0.95 to 1.00 and more preferably 0.98 to 1.00. In the present invention, all individual toner particles don't need to have a practical sphericity falling in the above range, but the requirement is fulfilled if the number average practical sphericity may fall in the above range. The number average practical sphericity is calculated from the values of the practical sphericities of 20 toner particles which are sampled at random from the obtained toner particles.

The particle diameter of the toner is generally 2 to 20 $\mu$m and preferably 3 to 10 $\mu$m in terms of medium diameter (d50).

Examples of the polyester (i-a) modified by a urethane bond among the polyesters (i) modified by a urethane bond and/or by a urea bond include reaction products of a hydroxyl group-containing polyester, which is a condensation-polymerized product of a polyol (1) and a polycarboxylic acid (2), and a polyisocyanate (3).

To allow the condensation-polymerized product of the polyol (1) and the polycarboxylic acid (2) to contain a hydroxyl group, the method may be adopted in which the hydroxyl group in the polyol (1) is reacted in a more excessive amount than the carboxylic group in the polycarboxylic acid (2).

The number of hydroxyl groups contained in one molecule of the polyester having hydroxyl groups is generally 1 or more, preferably 1.5 to 3 in average and 1.8 to 2.5 in average. By setting the number of hydroxyl groups to 1 or more per one molecule, the molecular weight of the urethane-modified polyester is increased and the hot offset resistance is improved.

Given as examples of the polyol (1) are diols (1-1) and polyols (1-2) having three or more valences. It is preferable to use the compound (1-1) singly or a mixture of the compound (1-1) and a small amount of the compound (1-2).

Examples of the diols (1-1) include C2–C18 alkylene glycols (e.g., ethylene glycol, 1,2-propylene glycol, 1,3-propylene glycol, 1,4-butane diol, neopentyl glycol, 1,6-hexane diol and dodecane diol); alkylene ether glycols having C2–C4 alkylene groups and a molecular weight of 106 to 10000 (e.g., diethylene glycol, triethylene glycol, dipropylene glycol, polyethylene glycol, polypropylene glycol and polytetramethylene ether glycol); C5–C18 alicyclic diols (e.g., 1,4-cyclohexane dimethanol and hydrogenated bisphenol A); C12–C23 bisphenols (e.g., bisphenol A, bisphenol F and bisphenol S); C2–C18 alkylene oxides (e.g., ethylene oxide, propylene oxide, butylene oxide and $\alpha$-olefin oxide) addition products (the number of addition mols is 2 to 20) of the above alicyclic diols or bisphenols.

Among these compounds, C2–C12 alkylene glycols and C2–C18 alkylene oxide addition products of bisphenols are preferable. Also, combinations of alkylene oxide addition products (particularly, ethylene oxide or propylene (2–3 mols) addition products of bisphenols (particularly, bisphenol A) and C2–C12 alkylene glycols (particularly, ethylene glycol, 1,2-propylene glycol, 1,4-butane diol or neopentyl glycol) are particularly preferable.

In the case of the combinations, the ratio of the alkylene oxide addition product of bisphenols is generally 30 mol % or more, preferably 50 mol % or more and particularly preferably 70 mol % or more.

Examples of the polyols (1-2) with three or more valences include polyhydric aliphatic alcohols having 3–8 or more valences (e.g., glycerol, trimethylolethane, trimethylol propane, pentaerythritol and sorbitol); phenols having 3-8 or more valences (e.g., trisphenol PA, phenol novolak and cresol novolak); and C2–C18 alkylene oxide addition products (the number of addition mols is 2 to 20) of the above polyphenols having three or more valences.

Given as preferable examples of the polycarboxylic acid (2) are dicarboxylic acids (2-1) and polycarboxylic acids having three or more valences (2-2). It is preferable to use the dicarboxylic acid (2-1) singly or mixtures of the dicarboxylic acid (2-1) and a small amount of the polycarboxylic acid (2-2).

Examples of the dicarboxylic acid (2-1) include C2–C20 alkylenedicarboxylic acids (e.g., succinic acid, adipic acid, sebacic acid, dodecanedicarboxylic acid, dodecenylsuccinic acid and dodecylsuccinic acid); alkenylenedicarboxylic acid (e.g., maleic acid and fumaric acid); and aromatic dicarboxylic acids (e.g., phthalic acid, isophthalic acid, terephthalic acid and naphthalenedicarboxylic acid). Among these compounds, C4–C20 alkenylenedicarboxylic acids (particularly, adipic acid and dodecenylsuccinic acid) and C8–C20 aromatic dicarboxylic acids (particularly, isophthalic acid and terephthalic acid) are preferable.

Given as examples of the polycarboxylic acid (2-2) are C9–C20 aromatic polycarboxylic acid (e.g., trimellitic acid and pyromellitic acid).

As the polycarboxylic acid (2), acid anhydrides or lower alkylesters (e.g., methylesters, ethylesters and isopropylesters) of the above exemplified compounds may be reacted with the polyol (1).

The ratio of the polyol (1) to the polycarboxylic acid (2) is generally 2/1 to 1/1, preferably 1.5/1 to 1/1 and more preferably 1.3/1 to 1.02/1 in terms of equivalent ratio of a hydroxyl group [OH] to a carboxyl group [COOH], namely [OH]/[COOH].

The number average molecular weight of the polyester having a hydroxyl group is generally 1000 to 20000, preferably 1500 to 15000 and particularly preferably 2000 to 10000. The weight average molecular weight of the polyester is generally 2000 to 50000, preferably 3000 to 30000 and particularly preferably 4000 to 20000.

The hydroxyl value of the polyester having a hydroxyl group is generally 5 to 120, preferably 7 to 70 and particularly preferably 10 to 60. The acid value is generally 10 or less, preferably 5 or less and particularly preferably 2 or less.

Given as examples of the polyisocyanate (3) are C6–C20 (excluding carbon atoms contained in NCO groups, the same as follows) aromatic polyisocyanates, C2–C18 aliphatic polyisocyanates, C4–C15 alicyclic polyisocyanates, C8–C15 aromatic aliphatic polyisocyanates, modified products of these polyisocyanates (modified products containing a urethane group, carbodiimide group, allophanate group, urea group, biuret group, urethodione group, urethoimine group, isocyanurate group or oxazolidone group) and mixtures of two or more of these compounds.

Specific examples of the aromatic polyisocyanate include 1,3- and/or 1,4-phenylene diisocyanate, 2,4- and/or 2,6-tolylene diisocyanate (TDI), crude TDI, 2,4'-and/or 4,4'-diphenylmethane diisocyanate (MDI), crude MDI [a carbonyl chloride of crude diaminophenylmethane {a condensation product of formaldehyde and an aromatic amine (aniline) or its mixture; a mixture of diaminophenylmethane and a small amount (for example, 5–20 wt %) of a tri- or more functional polyamine}: polyallyl polyisocyanate (PAPI)], 1,5-naphthylene diisocyanate, 4,4',4"-triphenylmethane triisocyanate, m- and p-isocyanatophenylsulfonyl isocyanate.

Given as specific examples of the aliphatic polyisocyanate are ethylene diisocyanate, tetramethylene diisocyanate, hexamethylene diisocyanate (HDI), dodecamethylene diisocyanate, 1,6,11-undecane triisocyanate, 2,2,4-trimethylhexamethylene diisocyanate, lysine diisocyanate, 2,6-diisocyanatomethyl caproate, bis(2-isocyanatoethyl) fumarate, bis(2-isocyanatoethyl) carbonate, 2-isocyanatoethyl-2,6-diisocyanato hexanoate.

Specific examples of the alicyclic polyisocyanate include isophorone diisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate and 2,5- and/or 2,6-norbornane diisocyanate.

Specific examples of the aromatic aliphatic polyisocyanate include m- and/or p-xylylene diisocyanate (XDI) and α,α,α,α-tetramethylxylylene diisocyanate (TMXDI).

The aforementioned modified products of polyisocyanates include modified MDIs (urethane-modified MDIs, carbodiimide-modified MDIS, trihydrocarbyl phosphate-modified MDIS, and urethane-modified TDIs and mixtures of two or more of these compounds [for example, combinations of modified MDIs and urethane-modified TDIs (isocyanate-containing prepolymers)].

Among these compounds, C6–C15 aromatic polyisocyanates, C4–C12 aliphatic polyisocyanates and C4–C15 alicyclic polyisocyanates are preferable. TDIs, MDIs, HDIs, hydrogenated MDIs and IPDIs are particularly preferable.

When the polyester having a hydroxyl group is reacted with the polyisocyanate (3), another polyol (B) may be further used together. The combined use of the polyol is liable to improve the hot offset resistance.

As examples of the polyol (B), the same compounds that are used for the polyol (1) which is the structural component of the aforementioned polyester may be given. Among these compounds, C2–C12 alkylene glycols and C2–C18 alkylene oxide addition products of bisphenols are preferable. Particularly preferable examples are C2–C6 alkylene glycols (especially, ethylene glycol, 1,4-butane diol and 1,6-hexane diol) and alkylene oxide addition products (especially, ethylene oxide or propylene oxide (2–3 mols) addition products) of bisphenols (especially, bisphenol A).

The ratio of the polyester to polyol which have a hydroxyl group is generally 1/0 to 1/5 and preferably 1/0 to 1/3 in terms of equivalent ratio of hydroxyl groups.

Moreover, a monool may be partially combined for the purpose of adjusting the molecular weight of the urethane-modified polyester. The ratio of the monool is generally 0.1 to 10 equivalent %, preferably 0.5 to 7 equivalent % and particularly preferably 0.75 to 5 equivalent % in terms of equivalent ratio of hydroxyl groups of the monool to all hydroxyl groups.

Examples of the monool include C1–C22 alkyl alcohols (e.g., methanol, ethanol, butanol, octanol, lauryl alcohol and stearyl alcohol); aralkyl alcohols (e.g., benzyl alcohol); alkylene addition products of phenols (e.g., ethylene oxide addition products of phenol and ethylene oxide addition products of nonylphenol, the number of addition mols: 2–20).

The ratio of the polyisocyanate (3) is generally to 2/1, preferably 1.5/1 to 1/1.5 and more preferably 1.2/1 to 1/1.2 in terms of equivalent ratio of an isocyanate group [NCO] to the total hydroxyl groups [OH] contained in the polyester and polyol which have a hydroxyl group, namely [NCO]/[OH].

When the ratio [NCO]/[OH] falls in the above range, the molecular weight of the urethane-modified polyester is increased and the hot offset resistance is improved.

Given as examples of the polyester (i-b) modified by a urea bond are reaction products of a polyester polymer (a) having an isocyanate group and amines (b).

Given as examples of the polyester prepolymer (a) having an isocyanate group are products synthesized by further reacting a polyester, which is a condensation-polymerized product of the polyol (1) and the polycarboxylic acid (2) and has an active hydrogen-containing group, with the polyisocyanate (3).

As the active hydrogen-containing group contained in the polyester, hydroxyl groups (alcoholic hydroxyl groups and phenolic hydroxyl groups) and carboxyl groups are exemplified. Among these compounds, alcoholic hydroxyl groups are preferable.

The alcoholic hydroxyl group-containing polyester can be obtained using an excess polyol in the same manner as in the case of the aforementioned polyester modified by a urethane bond. Also, the polyester having a carboxyl group can be obtained using an excess polycarboxylic acid on the contrary.

As examples of the polyol (1), polycarboxylic acid (2) and polyisocyanate (3), the same compounds that are used for the polyester (i-a) modified by a urethane bond may be given and preferable examples are the same.

The ratio of the polyisocyanate (3) is generally 5/1 to 1/1, preferably 4/1 to 1.2/1 and more preferably 2.5/1 to 1.5/1 in terms of equivalent ratio of an isocyanate group [NCO] to a hydroxyl group [OH] of the polyester having a hydroxyl group, namely [NCO]/[OH].

When the ratio [NCO]/[OH] falls in the above range, this is advantageous in view of the compatibility of the low temperature fixing ability with the hot offset resistance.

The number of isocyanate groups contained in one molecule of the polyester prepolymer (a) having an isocyanate group is generally 1 or more, preferably 1.5 to 3 in average and more preferably 1.8 to 2.5 in average.

When the number of isocyanate groups contained in one molecule is 1 or more, the molecular weight of the urea-modified polyester is increased and the hot offset resistance is improved.

The content of an NCO group (NCO equivalent) is generally 500 to 10000, preferably 700 to 8000 and particularly preferably 1000 to 5000.

Given as examples of the amines (b) are diamines (b1), polyamines with 3–6 or more valences (b2), amino-alcohols (b3), amino-mercaptans (b4), amino acids (b5) and the compounds (b6) produced by blocking the amino groups of the amines b1–b5.

Examples of the diamine (b1) include C6–C23 aromatic diamines (e.g., phenylenediamine, diethyltoluenediamine and 4,4'-diaminodiphenylmethane); C5–C20 alicyclic diamines (e.g., 4,4'-diamino-3,3'-dimethyldicyclohexylmethane, diaminocyclohexane and isophoronediamine); and C2–C18 aliphatic diamines (e.g., ethylene diamine, tetramethylenediamine and hexamethylenediamine).

Given as examples of the polyamine (b2) having 3–6 or more valences are diethylenetriamine and triethylenetetramine.

Given as examples of the aminoalcohols (b3) are those having 2-12 carbon atoms, specifically, ethanolamine and hydroxyethylaniline.

Given as examples of the aminomercaptan (b4) are those having 2–12 carbon atoms, specifically, aminoethylmercaptan and aminopropylmercaptan.

Given as examples of the amino acid (b5) are those having 2–12 carbon atoms, specifically, aminopropionic acid and aminocaproic acid.

Given as examples of the compounds (b6) produced by blocking the amino groups of the amines b1–b5 are ketimine compounds and oxazoline compounds obtained from the amines b1–b5 and C3–C8 ketones (e.g., acetone, methyl ethyl ketone, methyl isobutyl ketone).

Preferable examples among these amines (b) are the amines b1 (particularly, 4,4'-diaminodiphenylmethane, isophoronediamine and ethylenediamine) and mixtures of the amines b1 and a small amount of the amines b2 (especially, diethylenetriamine). The ratio by mol of the amine b1 to the amine b2 is generally 100/0 to 100/10 and preferably 100/0 to 100/5.

Moreover, the molecular weight of the urea-modified polyester may be controlled as required using a reaction stopper. As the reaction stopper, monoamines (e.g., diethylamine, dibutylamine, butylamine and laurylamine) and the products (e.g., ketimine compounds) obtained by blocking these compounds may be exemplified.

The ratio of the amines (b) is generally 1/2 to 2/1, preferably 1.5/1 to 1/1.5 and more preferably 1.2/1 to 1/1.2 in terms of equivalent ratio of an isocyanate group [NCO] contained in the prepolymer (a) having an isocyanate group to an amino group [NHR] (R is a hydrogen atom or an alkyl group) contained in the amines (b), namely [NCO]/[NHR].

When the amines b3–b5 are used as the amines (b), the ratio of [NCO] to the active hydrogen-containing group [YHx] (the total of amino groups, hydroxyl groups and mercapto groups or carboxyl groups) contained in the amines (b), namely, [NCO]/[YHx] is generally 1/2 to 2/1, preferably 1.5/1 to 1/1.5 and more preferably 1.2/1 to 1/1.2.

When the equivalent ratio falls in the above defined range, the molecular weight of the urea-modified polyester (i-b) is increased and the hot offset resistance is improved.

In the invention (I), a urethane bond may be included together with a urea bond in the polyester (i-b) modified by the urea bond. The ratio of the urea bond to the urethane bond is generally 10/0 to 1/9, preferably 8/2 to 2/8 and more preferably 6/4 to 3/7. The introduction of the urethane bond in addition to the urea bond contributes to an improvement in the hot offset resistance.

The content of the urea bond and urethane bond is generally 300 to 8000, preferably 400 to 5000 and particularly preferably 600 to 4000 in terms of the total equivalents of the urea bond and urethane bond.

The polyesters (i) modified by a urethane bond and/or by a urea bond may be produced by a one shot method or a prepolymer method.

The weight average molecular weight of the modified polyester (i) is generally $1\times10^4$ or more, preferably $2\times10^4$ to $1\times10^7$ and more preferably $3\times10^4$ to $1\times10^6$. When the weight average molecular weight falls in this range, the hot offset resistance is improved.

No particular limitation is imposed on the number average molecular weight of the modified polyester, particularly when the unmodified-polyester (ii) described later is used and the number average molecular weight may be one enabling it possible to attain the above weight average molecular weight. When the modified polyester (i) is singly used, the number average molecular weight is generally 20000 or less, preferably 1000 to 10000 and more preferably 2000 to 8000. When the number average molecular weight falls in this range, the low temperature fixing ability and the glossiness when the modified polyester is used in a full color system are improved.

The number average molecular weight and the weight average molecular weight may be measured as those converted into polystyrene in a well-known method using gel permeation chromatography (GPC).

In the present invention, not only the single use of the polyester (i) modified by a urethane bond and/or a urea bond is allowed but also the unmodified-polyester (ii) in addition to the polyester (i) may be contained as a toner binder component. The combined use of the polyester (ii) is more desirable than the single use of the polyester (i) because the low temperature fixing ability and the glossiness when the polyester is used in a full color system are improved.

Given as examples of the polyester (ii) are the same condensation-polymerized products of the polyol (1) and the polycarboxylic acid (2) as the aforementioned examples used for the polyester component (i). Preferable examples are the same as those used for the polyester (i)

The polyester (ii) is not limited to the unmodified-polyesters but may be those modified by chemical bonds other than a urethane bond or a urea bond and for instance, those modified by an amide bond are preferably used.

In the case of modifying using an amide bond, for instance, the method is adopted in which a polyamine or an amino-alcohol is condensed together with the polyol (1) and the polycarboxylic acid (2) when the polyester (ii) is condensation-polymerized. Given as examples of the polyamine and aminoalcohol may be those exemplified for the aforementioned amines b1 to b3.

It is preferable that at least each part of the polyesters (i) and (ii) be mutually solved in view of the low temperature fixing ability and hot offset resistance. Accordingly, it is desirable that the polyester components (i) and (ii) have similar compositions.

When the polyester (ii) is contained, the ratio by weight of the polyester (i) to the polyester (ii) is generally 5/95 to 80/20, preferably 5/95 to 30/70, more preferably 5/95 to 25/75 and particularly preferably 7/93 to 20/80.

It is desirable that the polyester (ii) have a peak molecular weight in a range between, generally 1000 and 10000, preferably 1500 and 10000 and more preferably 2000 and 8000 in a chromatogram of gel permeation chromatography (GPC). When the peak molecular weight falls in this range, this is advantageous in view of the compatibility of the storage stability under heat with the low temperature fixing ability.

The hydroxyl value of the polyester (ii) is preferably 5 or more, more preferably 10 to 120 and particularly preferably 20 to 80. When the hydroxyl value falls in this range, this is advantageous in view of the compatibility of the storage stability under heat. with the low temperature fixing ability.

The acid value of the polyester (ii) is generally 0 to 120, preferably 0 to 50 and more preferably 0 to 30. By the provision of a certain acid value, the polyester tends to be negatively charged with ease.

In the invention (I), the glass transition temperature (Tg) of the toner binder is generally 35 to 85° C. and preferably 45 to 70° C. The temperature of 35° C. or more improves the storage stability of the toner under heat and the temperature of 85° C. or less improves the low temperature fixing ability. The toner of the present invention tends to exhibit excellent storage stability in contrast to well-known polyester type toners even if the glass transition temperature is low although this reason is not clarified.

As to the elastic modulus (G') of the toner binder during storage, the temperature (Ts) when the elastic modulus reaches 10000 dyne/cm$^2$ at a measuring frequency of 20 Hz is generally 100° C. or more and preferably 110 to 200° C. When the temperature is 100° C. or more, the hot offset resistance is improved.

With regard to the viscosity of the toner binder, the temperature (Tη)) when the viscosity reaches 1000 poises at a measuring frequency of 20 Hz is generally 180° C. or less and preferably 90 to 160° C. When the temperature is 180° C. or less, the low temperature fixing ability is improved.

It is desirable that the temperature Ts be higher than the temperature Tη in view of the compatibility of the low temperature fixing ability with the hot offset resistance. In other words, the difference between the temperature Ts and the temperature Tη, namely (Ts--Tη) is preferably 0° C. or more, more preferably 10° C. or more and particularly preferably 20° C. or more. There is no limitation to the upper limit of the difference.

It is desirable that the difference between the temperature Tη and the temperature Tg, namely (Tη−Tg) is preferably 0 to 100° C., more preferably 10 to 90° C. and particularly preferably 20 to 80° C. in view of the compatibility of the storage stability under heat with the low temperature fixing ability.

As the colorant used in the present invention, well-known dyes, pigments and magnetic powders may be used. Specific examples of the colorant include carbon black, Sudan Black SM, Fast Yellow G, Benzidine Yellow, Pigment Yellow, Indo-fast Orange, Irgacine Red, Balanito aniline Red, toluidine Red, carmine FB, Pigment Orange R, Lake Red 2G, Rhodamine FB, Rhodamine B lake, Methyl Violet B lake, Phthalocyanine Blue, Pigment Blue, Brilliant Green, Phthalocyanine Green, Oil Yellow GG, Kayaset YG, Orazole Brown B, Oil Pink OP, magnetite and Iron Black.

The content of the colorant is generally 2 to 15% by weight and preferably 3 to 10% by weight.

The toner of the present invention may include a wax as a releasing agent in combination of the toner binder and the colorant.

Given as examples of the wax which can be used in the present invention are well-known waxes, such as polyolefin waxes (e.g., polyethylene wax and polypropylene wax); long chain hydrocarbons (e.g., paraffin wax and sazole wax); and carbonyl group-containing waxes. Among these waxes, carbonyl group-containing waxes are preferable.

Examples of the carbonyl group-containing wax include polyalkanates (e.g., carnauba wax, montan wax, trimethylolpropane tribehenate, pentaerythritol tetrabehenate, pentaerythritol diacetate dibehenate, glycerol behenate and 1,18-octadecanediol distearate); polyalkanol esters (e.g., tristearyl trimellitate and distearyl maleate); polyalkanic acid amides (e.g., ethylenediaminedibehenylamide); polyalkylamides (e.g., tristearylamide trimellitate); and dialkyl ketones (e.g., distearyl ketone).

Among these carbonyl group-containing waxes, polyalkanates are preferable.

The melting point of the wax used in the present invention is generally 40 to 1600° C., preferably 50 to 120° C. and more preferably 60 to 90° C. Waxes having a melting point less than 40° C. adversely affect the storage stability under heat whereas waxes having a melting point exceeding 160° C. tends to cause a cold offset during a fixing step performed at low temperatures.

The melt viscosity of the wax used in the present invention is preferably 5 to 1000 cps and more preferably 10 to 100 cps as the value measured at a temperature 20° C. higher than the melting point. Waxes having a viscosity exceeding 1000 cps produce only a poor effect on the hot offset resistance and the low temperature fixing ability.

The content of the wax in the toner is generally 0 to 40% by weight, preferably 3 to 30% by weight and particularly preferably 10 to 25% by weight.

In the toner of the present invention, a charge control agent and a fluidization agent may be further used.

Given as examples of the charge control agent are well-known materials, specifically, nigrosine dyes, quaternary ammonium salt compounds, quaternary ammonium salt-containing polymers, metal-containing azo dyes, metal salicylates, sulfonic acid group-containing polymers, fluorine-containing polymers and halogen substituted aromatic ring-containing polymers.

The content of the charge control agent is generally 0 to 5% by weight.

As the fluidization agent, well-known materials such as colloidal silica, alumina powder, titanium oxide powder and calcium carbonate powder may be used.

No particular limitation is imposed on the method for the production of the toner of the invention (I) and the toner may be produced, for instance, by the method for the production of the toner of the invention (II) o:r by the method of globing the toner binder of the invention (III) by a well-known method.

As for the method of globing the toner binder of the invention (III), the toner may be manufactured by the following methods (1) to (3).

(1) Globing of Pulverized Toners

A toner composition consisting of a toner binder and a colorant is melted and kneaded and thereafter pulverized and the resulting product is mechanically globed using a hybridizer or a mechano-fusion.

(2) Spray Drying Method

A toner composition is dissolved and dispersed in a solvent which can solve a toner binder, followed by distilling the solvent by using a spray drying apparatus to obtain globular toners.

(3) Dispersion Granulation Method (e.g., the Method Described in JP-A No. H9-15902)

A toner composition is dissolved and dispersed in a solvent which can solve a toner binder and thereafter dispersed in a poor solvent (e.g., water) for the toner binder while stirring, followed by distilling the solvent to form toner particles. After the toner particles are cooled, they are subjected to solid-liquid separation and drying to obtain globular toners.

Among these methods, the dispersion granulation method (3) is preferred. A dispersion granulation method in which the poor solvent to be a dispersion phase is an aqueous medium is particularly desirable.

Given as examples of the solvent used to solve the toner binder in advance in the dispersion granulation method using the aqueous medium are ethyl acetate, acetone and methyl ethyl ketone.

As required, a dispersant may be used. The use of the dispersant is rather preferable because sharp size distribution is obtained and stable dispersion is attained.

As the dispersant, well-known materials such as water-soluble polymers (e.g., polyvinyl alcohols and hydroxyethyl cellulose), inorganic powders (e.g., calcium carbonate powder, calcium phosphate powder and silica micropowder) and surfactants (e.g., sodium lauryl sulfate and sodium oleate) may be used.

When the dispersant is used, it is desirable in view of the charging of the toner to remove the dispersant by washing after the solid-liquid separation is performed, although the dispersant may be left on the surface of the toner particle.

Next, the invention (II) will be explained in detail.

The toner of the invention (II) comprises particles produced by forming a dispersion of a reactive group-containing prepolymer (α) in an aqueous medium and by reacting the prepolymer (α) with an extension agent and/or a crosslinking agent (β) to extend and/or crosslink the prepolymer (α).

Examples of combinations of the reactive group contained in the reactive group-containing prepolymer (α) and the extension agent and/or the crosslinking agent (β) may include the following combinations ① and ②:

① a combination of a functional group (α1), which is reactive with an active hydrogen compound, as the reactive group contained in the prepolymer (α) and an active hydrogen group-containing compound (β1) as the crosslinking agent (β); and ② a combination of an active hydrogen-containing group (α2) as the reactive group contained in the prepolymer (α) and a compound (β2), which is reactive with the active hydrogen group-containing compound, as the crosslinking agent (β).

Among these combinations, the combination ① is more preferred.

Given as examples of the functional group (α1) reactive with an active hydrogen compound in the combination ① are an isocyanate group (α1a), blocked isocyanate group (α1b), epoxy group (α1c), acid anhydride group (α1d) and acid halide group (α1e). Among these groups, the isocyanate group (α1a), blocked isocyanate group (α1b) and epoxy group (α1c) are preferred. The isocyanate group (α1a) and blocked isocyanate group (α1b) are particularly preferred.

As the blocked isocyanate group (α1b), those produced by blocking an isocyanate group with a phenol derivative, oxime, caprolactam or the like are exemplified.

Given as examples of the active hydrogen group-containing compound (β1) are polyamines (β1a) which may be blocked, polyols (β1b) and polymercaptans (β1c) and water (β1d). Among these groups, polyamines (β1a), polyols (β1b) and water (β1d) are preferred. Polyamines (β1a) and water (β1d) are more preferred and blocked polyamines and water (β1d) are particularly preferred.

Given as examples of the polyamines (β1a) are diamines (β1a-1) and polyamines (β1a-2) having 3–6 or more valences. As the blocked polyamines, ketimine compounds are preferred.

As the diamine (β1a-1), the same compounds that are used for the diamine (b1) used in the invention (I) are exemplified and as the polyamine (β1a-2) having 3–6 or more valences, the same compounds that are used for the polyamine (b2) are exemplified. Preferable examples are also the same.

Given as examples of the compounds in which polyamines are blocked with a releasable blocking agent are ketimine compounds and oxazoline compounds obtained from the aforementioned polyamines and C3–C8 ketones (e.g., acetone, methyl ethyl ketone and methyl isobutyl ketone).

Given as examples of the polyols (β1b) are the same compounds used for the polyol (1) in the invention (I). Preferable examples among these compounds are C2–C12 alkylene glycols (particularly, ethylene glycol, 1,4-butanediol and 1,6-hexanediol) and alkylene oxide addition products (particularly, ethylene oxide or propylene oxide (2–3 mols) addition products) of bisphenols (bisphenol A).

As the polymercaptans (β1c), ethylenedithiol, 1,4-butanedithiol and 1,6-hexanedithiol are exemplified.

Further, as required, a reaction stopper may be used together with the active hydrogen group-containing compound (β1). Given as examples of the reaction stopper are monoamines (e.g., diethylamine, dibutylamine, butylamine and laurylamine); blocked monoamines (e.g., ketimine compounds); monools (e.g., methanol, ethanol, isopropanol, butanol and phenol); and monomercaptans (e.g., butylmercaptan and laurylmercaptan).

Examples of the active hydrogen-containing group (α2) comprised in the prepolymer (α) used in the combination (2) include amino groups (α2a) which may be blocked, hydroxyl groups (α2b) (alcoholic hydroxyl groups and phenolic hydroxyl groups), mercapto groups (α2c) and carboxyl groups (α2d). Among these groups, amino groups (α2a) and hydroxyl groups (α2b) are preferred and hydroxyl groups (α2b) are particularly preferred.

Given as examples of the blocked amino group are ketimine groups and oxazoline groups which are obtained by reacting an amino group with ketones (e.g., acetone, methyl ethyl ketone and methyl isobutyl ketone).

Given as examples of the compound (β2) reactive with the active hydrogen-containing group are polyisocyanates (β2a), polyepoxides (β2b), polycarboxylic acids (β2c), polyacid anhydrides (β2d) and polyacid halides (β2e). Among these compounds, polyisocyanates (β2a) and DolyeDoxides (β2b) are Dreferred and polyisocyanates (β2a) are more preferred.

Given as examples of the polyisocyanates (β2a) are the same compounds that are used for the polyisocyanate (3) used in the invention (I). Preferable examples are also the same.

Examples of the polyepoxides (β2b) include polyglycidyl ether (e.g., ethylene glycol diglycidyl ether, tetramethylene glycol diglycidyl ether, bisphenol A diglycidyl ether, bisphenol F diglycidyl ether, glycerol triglycidyl ether, pentaerythritol tetraglycidyl ether and phenolnovolac glycidyl ether); and diene oxides (e.g., pentadiene dioxide and hexadiene dioxide). Among these compounds, polyglycidyl ethers are preferable.

Given as examples of the polycarboxylic acids (β2c) are the same compounds that are used for the polycarboxylic acids (2) in the invention (I). Preferable examples are also the same.

Given as examples of the polycarboxylic acid anhydrides (β2d) are pyromellitic acid anhydride.

Given as examples of the polyacid halides (β2e) are acid halides (e.g., acid chlorides, acid bromides and acid iodides) of the polycarboxylic acids (β2c).

Furthermore, a reaction stopper may be used as required together with the compound (β2). Examples of the reaction stopper include monoisocyanates (e.g., lauryl isocyanate and phenyl isocyanate), monoepoxides (e.g., butylglycidyl ether), monoamines (e.g., diethylamine, dibutylamine, butylamine and laurylamine); blocked monoamines (e.g., ketimine compounds); monools (methanol, ethanol, isopropanol, butanol and phenol); and monomercaptans (e.g., butylmercaptan and laurylmercaptan).

The ratio of the prepolymer (α) to the extension agent and/or crosslinking agent (β) is generally to 2/1, preferably 1.5/1 to 1/1.5 and more preferably 1.2/1 to 1/1.2 in terms of ratio [α]/[β] of the equivalent number [α] of reactive groups contained in the reactive group-containing prepolymer (α) to the equivalent number [β] of the active hydrogen-containing groups contained in the compound (β). It is to be noted that in the case where the compound (β) is water (β1e), water is treated as a divalent active hydrogen compound. When the ratio [α]/[β] falls in the above range, the hot offset resistance is improved.

Given as examples of the prepolymer (α) are polyester prepolymers (αx), epoxy resin prepolymers (αy) and polyurethane prepolymers (αz). Among these compounds, the prepolymers (αx) and (αy) are preferred and the prepolymers (αx) are particularly preferable.

Given as examples of the polyester prepolymer (αx) are condensation-polymerized products of the polyols (1) and polycarboxylic acids (2) which are used in the invention (I). Preferable examples are also the same.

Given as examples of the epoxy resin prepolymer (αy) are addition condensation products of bisphenols (bisphenol A, bisphenol F and bisphenol S) and epichlorohydrin.

Given as examples of the polyurethane prepolymer (αz) are polymerized addition products of the polyols (1) and polyisocyanates (3).

Given as examples of the polyols (1) and polyisocyanates (3) are the same compounds that are used in the invention (I). Preferable examples are also the same.

The prepolymers (αx), (αy) and (αz) are allowed to contain a reactive group by a method (1) in which one structural component is excessively used to thereby leave a functional group of the structural component at the terminal or by a method (2) in which the prepolymer obtained in the method (1) is further reacted with a reactive functional group-containing compound.

In the method (1), a hydroxyl group-containing polyester prepolymer, carboxyl group-containing polyester prepolymer, acid halide group-containing polyester prepolymer, hydroxyl group-containing epoxy resin prepolymer, epoxy group-containing epoxy resin prepolymer, hydroxyl group-containing polyurethane prepolymer or isocyanate group-containing polyurethane prepolymer is obtained.

As to the ratio of the structural components, for example, in the case of the hydroxyl group-containing polyester prepolymer, the ratio of the polyol (1) to the polycarboxylic acid (1) is generally 2/1 to 1/1, preferably 1.5/1 to 1/1 and more preferably 1.3/1 to 1.02/1 in terms of equivalent ratio [OH]/[COOH] of a hydroxyl group [OH] to a carboxyl group [COOH]. In the case of other structural components and terminal prepolymers, the ratio is the same except that only the structural components are changed.

In the method ②, the prepolymer obtained in the method (1) is reacted with a polyisocyanate to obtain an isocyanate group-containing prepolymer, with a blocked polyisocyanate to obtain a blocked isocyanate group-containing prepolymer, with a polyepoxide to obtain an epoxy group-containing prepolymer and with a polyacid anhydride to obtain an acid hydride group-containing prepolymer.

Given as examples of the polyisocyanate are the same compounds that are used for the polyisocyanate (3) in the invention (I). Preferable examples are also the same.

As for the proportion of the reactive group-containing compound, for instance, in the case where a polyisocyanate is reacted with the hydroxyl group-containing polyester to obtain an isocyanate group-containing polyester prepolymer, the proportion of the isocyanate group is generally 5/1 to 1/1, preferably 4/1 to 1.2/1 and more preferably 2.5/1 to 1.5/1 in terms of equivalent ratio [NCO]/[OH] of an isocyanate group [NCO] to a hydroxyl group [OH] of the hydroxyl group-containing polyester. In the case of other structural components and terminal prepolymers, the ratio is the same except that only the structural components are changed.

The number of the reactive groups contained in one molecule of the prepolymer (α) is generally 1 or more, preferably 1.5 to 3 in average and more preferably 1.8 to 2.5 in average. If the number is in the above range, the molecular weight of the reaction product of the prepolymer (α) which is obtained by an extension reaction and/or by a crosslinking reaction is increased and the hot offset resistance is improved.

The number average molecular weight of the aprepolymer (α) is generally 500 to 30000, preferably 1000 to 20000 and more preferably 2000 to 10000.

The weight average molecular weight of the prepolymer (α) is generally 1000 to 50000, preferably 2000 to 40000 and more preferably 4000 to 20000 in view of the compatibility of the low temperature fixing ability with the hot offset resistance.

The molten viscosity of the prepolymer (α) at 100° C. is generally 2000 poises or less and preferably 1000 poises or less. A viscosity lower than 2000 poises is desirable because a toner having a sharp size distribution is obtained using a small solvent.

Moreover, as required, a reaction stopper may be used together with the compound (β). As the reaction stopper, the same compounds that are used in the invention (I) are exemplified.

In the toner of the present invention, a resin (I) produced from the prepolymer (α) by an extension reaction and/or by a crosslinking reaction using an extension agent and/or a crosslinking agent in an aqueous medium is used as the toner binder component. The weight average molecular weight of the resin (I) is generally $1\times10^4$ or more, preferably $2\times10^4$ to $1\times10^7$ and more preferably $3\times10^4$ to $1\times10^6$ in view of the hot offset resistance.

In addition, a so-called "dead polymer" which is a polymer which does not react with the prepolymer (α) and the compound (β) may be contained together with the prepolymer (α) in the system during the reaction of the prepolymer (α) with the compound (β) in an aqueous medium. Specifically, a resin (II) which participates in neither an extension reaction nor crosslinking reaction may be contained together with the resin (I) which has been made from the prepolymer (α) by an extension reaction and/or a crosslinking reaction in an aqueous medium.

The combined use of the dead polymer, namely the resin (II), improves the low temperature fixing ability and the glossiness when the toner is used in a full color system and is hence more desirable than the single use of the resin (I).

It is desirable that at least each part of the resins (I) and (II) mutually solve in view of the low temperature fixing ability and the hot offset resistance. Accordingly, the prepolymer (α) forming the resin (I) and the dead polymer which is the resin (II) have respective compositions similar to each other. Specifically, when the prepolymer (α) is a polyester prepolymer (αx), a condensation-polymerized product of the polyol (1) and the polycarboxylic acid (2) is preferable as the dead polymer.

Preferably the resin (II) has a peak molecular weight ranging generally from 1000 to 10000, preferably from 1500 to 10000 and more preferably from 2000 to 8000 in a chromatogram of gel permeation chromatography (GPC) in view of the storage stability under heat and low temperature fixing ability.

When the rein (II) is contained, the ratio by weight of the resin (I) to the resin (II) is generally 5/95 to 80/20, preferably 5/95 to 30/70, more preferably 5/95 to 25/75 and particularly preferably 7/93 to 20/80.

When the ratio by weight falls in the above range, the hot offset resistance is improved and this is advantageous in the compatibility of the storage stability under heat with the low temperature fixing ability.

In the invention (II), the glass transition temperature (Tg) of the toner binder component is 35 to 85° C. and preferably 45 to 70° C. A glass transition temperature higher than 35° C. improves the storage stability under heat whereas a glass transition temperature lower than 85° C. improves the low temperature. The toner of the present invention tends to exhibit excellent storage stability under heat in contrast to well-known polyester type toners even if the glass transition temperature is low although this reason is not clarified.

As to the elastic modulus (G') of the toner binder during storage, the temperature (Ts) at which the elastic modulus reaches 10000 dyne/cm$^2$ at a measuring frequency of 20 Hz is generally 100° C. or more and preferably 110 to 200° C. When the temperature is 100° C. or more, the hot offset resistance is improved.

With regard to the viscosity of the toner binder, the temperature (Tη) at which the viscosity reaches 1000 poises at a measuring frequency of 20 Hz is generally 180° C. or less and preferably 90 to 160° C. When the temperature is 180° C. or less, the low temperature fixing ability is improved.

It is desirable that the temperature Ts be higher than the temperature Tη in view of the compatibility of the low temperature fixing ability with the hot offset resistance. In other words, the difference between the temperature Ts and the temperature Tη, namely (Ts−Tη) is preferably 0° C. or more, more preferably 10° C. or more and particularly preferably 20° C. or more. There is no limitation to the upper limit of the difference.

It is desirable that the difference between the temperature Tη and the temperature Tg, namely (Tη−Tg) is preferably 0 to 100° C., more preferably 10 to 90° C. and particularly preferably 20 and 80° in view of the compatibility of the storage stability under heat with the low temperature fixing ability.

As the aqueous medium used in the invention (II), water may be used not only singly but also in combination with a solvent miscible with water.

Given as examples of the miscible solvent are alcohols (e.g., methanol, isopropanol and ethylene glycol), dimethylformamide, tetrahydrofuran, cellosolves (e.g., methyl cellosolve) and lower ketones (e.g., acetone and methyl ethyl ketone).

As the colorant, the same well-known dyes, pigments and magnetic powders that are used in the invention (I) may be used. The content of the colorant is the same as that in the invention (I).

Waxes may also be blended. As the wax, the same waxes that are used in the invention (I) may be exemplified. Preferable examples and the content are also the same.

Moreover, a charge control agent and a fluidization agent may be used like in the invention (I). Preferable S examples and the content are also the same.

The medium diameter (d50) of the particles formed by the extension reaction and/or crosslinking reaction of the prepolymer (α) is generally 2 to 20 μm, preferably 3 to 15 μm and more preferably 4 to 8 μm in view of the developing ability and resolution.

It is desirable that the particles be substantially spherical. The Wadell practical sphericity of the particles is generally 0.90 to 1.00, preferably 0.95 to 1.00 and more preferably 0.98 to 1.00. In the present invention, all individual toner particles don't need to have a practical sphericity falling in the above range, but the requirement is fulfilled if the number average practical sphericity may fall in the above range.

A method of the production of the toner of the invention (II) will be explained.

The toner particles are formed by reacting a dispersion consisting of the reactive group-containing prepolymer (α) with the compound (β) in an aqueous medium.

To form the dispersion consisting of the prepolymer (α) stably in an aqueous medium, the method, for example, may be adopted in which a composition of toner raw materials comprising the prepolymer (α) is blended in an aqueous medium and dispersed by shearing force.

The prepolymer (α) and other toner raw materials (e.g., a colorant, a releasing agent and a charge control agent) may be mixed with each other when the dispersion is formed in an aqueous medium. It is however more desirable that after the toner raw materials are mixed in advance, the mixture be blended and dispersed in the aqueous medium.

In the present invention, the other toner raw materials such as a colorant, releasing agent and charge control agent are not necessarily mixed when the particles are formed in the aqueous medium but may be added after the particles have been formed. For instance, after particles excluding a colorant have been formed, the colorant may be added by a well-known dyeing method.

No particular limitation is imposed on the dispersion method and well-known machines such as a low speed shearing type, high speed shearing type, friction type, high pressure jet type and ultrasonic type may be applied. It is desirable to use a high speed shearing type to obtain a dispersion having a particle diameter of 2 to 20 μm. When the high speed shearing type dispersing machine is used, the number of rotation is, though not limited to, generally 1000 to 30000 rpm and preferably 5000 to 20000 rpm and the dispersion time is, though not limited to, generally 0.1 to 5 minutes in a batch system.

The dispersion temperature is generally 0 to 150° C. (under pressure) and preferably 40 to 98° C. High dispersion temperature is desirable because the viscosity of the resulting dispersion consisting of the prepolymer (α) is decreased and the dispersion is easily attained.

The amount of the aqueous medium to be used for 100 parts by weight of the prepolymer (α) is generally 50 to 2000 parts by weight and preferably 100 to 1000 parts by weight. An amount less than 50 parts by weight leads to an impaired dispersion condition of the prepolymer (α) and hence toner particles with a desired particle size are not obtained whereas an amount exceeding 20000 parts by weight is uneconomical.

As required, a dispersant may be used. The use of the dispersant is desirable because a sharp size distribution is obtained and stable dispersion is secured.

As the dispersant, well-known materials such as water-soluble polymers (e.g., polyvinyl alcohols and hydroxyethyl cellulose), inorganic powders (e.g., calcium carbonate powder, calcium phosphate powder, hydroxyapatite powder and silica micropowder) and surfactants (e.g., sodium dodecylbenzene sulfonate, sodium lauryl sulfate and sodium oleate) may be used.

When the dispersant is used, it is desirable in view of the charging of the toner to remove the dispersant by washing after the extension and/or crosslinking reaction is performed, although the dispersant may be left on the surface of the toner particle.

A solvent capable of solving the prepolymer (α) may be used to decrease the viscosity of the dispersion consisting of the prepolymer (α). The use of such a solvent is rather desirable to make the size distribution sharp. It is desirable that the solvent have a boiling point less than 100° C. or be azeotropic together with water in the point that the solvent is easily removed. When the polyols (β1b) are used as the compound (β), it is desirable that the hydrophilicity of the solvent be low.

Given as examples of the solvent are ethyl acetate, acetone, methyl ethyl ketone and toluene.

The amount of the solvent to be used for 100 parts of the prepolymer (α) is generally 0 to 300 parts, preferably 0 to 100 parts and more preferably 25 to 70 parts.

When the solvent is used, it is removed by heating under normal pressure or reduced pressure after the extension and/or crosslinking reaction.

The extension and/or crosslinking reaction time is selected in accordance with the reactivity based on the combination of the structure of the reactive group contained in the prepolymer (α) and the extension agent and/or the crosslinking agents (β) and is generally 10 minutes to 40 hours and preferably 2 to 24 hours.

The reaction temperature is generally 0 to 150° C. and preferably 50 to 120° C.

A well-known catalyst may be used as required. In the reaction of an isocyanate, for instance, dibutyltin laurate and dioctyltin laurate may be given as examples of the catalyst.

Toner particles formed by the extension reaction and/or crosslinking reaction of the resulting dispersion is subjected to solid-liquid separation using a centrifugal separator, super-classification filter or filter press and the resulting powder is dried to obtain the toner of the present invention.

The resulting powder is dried using a well-known machine such as a fluidized bed dryer, vacuum dryer or circulating air dryer.

Also, as required, the resulting powder is classified using a pneumatic classifier or the like so that it has predetermined size distribution.

The toner of the present invention ,as necessary, is mixed with carrier particles, e.g., iron powder, glass beads, nickel powder, ferrite, magnetite and ferrite whose surface are coated with resins (e.g., acryl resins and silicone resins) for use as developer of an electric latent image.

It is also possible to form an electric latent image by rubbing the toner with an electrostatic charge component part like a charged blade instead of mixing the carrier particles.

The toner of the present invention is fixed to a support (e.g., paper and polyester films) by using a copying machine or a printer to form a recording material. To fix the toner to the support, a well-known heat roll fixing method or flash fixing method may be applied.

Next, the toner binder of the invention (III) will be explained.

Given as examples of the polyester (i-a) modified by a urethane bond among the polyester (i) modified by a urethane bond and/or a urea bond are reaction products of the polyester (A) having a hydroxyl group and the polyisocyanate (3) or reaction products of the polyester (A), the polyisocyanate (3) and the polyol (B).

As the polyisocyanate (3), the same compounds that are used for the polyisocyanate (3) in the invention (I) are exemplified. Preferable examples are also the same. As the polyol (B), the same compounds that are used for the polyol (B) in the invention (I) are exemplified and preferable examples are likewise the same.

The ratio of the polyester (A) to the polyol (B) is generally 1/0 to 1/5 and preferably 1/0 to 1/3 in terms of equivalent ratio $[OH_A]/[OH_B]$ of a hydroxyl group $[OH_A]$ of the polyester (A) to a hydroxyl group $[OH_B]$ of the polyol (B).

The proportion of the polyisocyanate (3) is generally 1/2 to 2/1, preferably 1.5/1 to 1/1.5 and more preferably 1.2/1 to 1/1.2 in terms of equivalent ratio [NCO]/[OH] like in the above invention (I). The content of the polyisocyanate (3) is also the same as that in the invention (I).

Also, the same monool that is used in the invention (I) may be used.

Given as examples of the polyester (A) having a hydroxyl group are condensation-polymerized products made from the polyol (1) and the polycarboxylic acid (2) and produced using the polyol (1) in an excess ratio to the polycarboxylic acid (2) in terms of ratio of the number of mols of a hydroxyl group contained in the polyol (1) to the number of mols of a carboxylic group contained in the polycarboxylic acid (2).

The number of hydroxyl groups contained in one molecule of the polyester having a hydroxyl group is generally 1 or more, preferably 1.5 to 3 in average and more preferably 1.8 to 2.5 in average. When the number falls in the above range, the molecular weight of the urethane-modified polyester is increased and the hot offset resistance is improved.

As examples of the polyol (1) and polycarboxylic acid (2), the same compounds that are used for the polyol (1) and polycarboxylic acid (2) in the invention (I) may be given and preferable examples are also the same.

The ratio of the polyol (1) to the polycarboxylic acid (2) is also the same as that in the invention (I).

The molecular weight, hydroxyl value and acid value of the polyester (A) are the same as those in the invention (I).

Given as examples of the polyester (i-b) modified by a urea bond are reaction products of the polyester prepolymer (a) having an isocyanate group and the amines (b) and reaction products of a polyester prepolymer having an amino group and a polyisocyanate. Among these compounds, it is desirable to use the reaction products of the polyester prepolymer (a) and the amines (b).

Given as examples of the polyester prepolymer (a) having an isocyanate group are compounds produced by further reacting a polyester, which is a condensation-polymerized product of the polyol (1) and the polycarboxylic acid (2) and has an active hydrogen-containing group, with the polyisocyanate (3).

Examples of the active hydrogen-containing group contained in the polyester include a hydroxyl group (an alcoholic hydroxyl group and a phenolic hydroxyl group) and a carboxyl group. Among these groups, an alcoholic hydroxyl group is preferable.

Given as examples of the polyol (1), polycarboxylic acid (2), polyisocyanate (3) and amines (b) are the same compounds that are used for the polyol (1), polycarboxylic acid (2), polyisocyanate (3) and amines (b) in the invention (I) respectively. Preferable examples are also the same.

Each ratio and content of these compounds (1), (2), (3) and (b) are the same as those in the invention (I).

As required, the same reaction stopper that are used in the invention (I) may be used.

In the invention (III), a urethane bond may also be included together with a urea bond in the polyester (i-b) modified by the urea bond. The ratio of the urea bond to the urethane bond is generally 10/0 to 1/9, preferably 8/2 to 2/8 and more preferably 6/4 to 3/7 in view of the hot offset resistance.

The content of the urea bond and urethane bond is generally 300 to 8000, preferably 400 to 5000 and particularly preferably 600 to 4000 in terms of the total equivalents of the urea bond and urethane bond.

The polyesters (i) modified by a urethane bond and/or by a urea bond may be produced by a one shot method or a prepolymer method.

The weight average molecular weight of the modified polyester (i) is generally $1\times10^4$ or more, preferably $2\times10^4$ to $1\times10^7$ and more preferably $3\times10^4$ to $1\times10^6$. When the weight average molecular weight falls in this range, the hot offset resistance is improved.

No particular limitation is imposed on the number average molecular weight of the modified polyester and the number average molecular weight may be one enabling it possible to attain the above weight average molecular weight.

The number average molecular weight and the weight average molecular weight may be measured as those converted into polystyrene in a well-known method using gel permeation chromatography (GPC).

In the invention (III), not only the single use of the polyester (i) modified by a urethane bond and/or a urea bond is allowed but also the unmodified-polyester (ii) in addition to the polyester (i) may be contained as a toner binder component.

The combined use of the polyester (ii) is desirable because the low temperature fixing ability and the glossiness when used in a full color system are improved.

Given as examples of the polyester (ii) which is modified neither by a urethane bind nor by a urea bond are the same condensation-polymerized products of the polyol (1) and the polycarboxylic acid (2) as the aforementioned examples used for the polyester component (i). Preferable examples are the same as those used for the polyester (i).

The polyester (ii) is not limited to the unmodified-polyesters but may be those modified by chemical bonds other than a urethane bond or a urea bond and for instance, those modified by an amide bond are preferably used.

In the case of modifying using an amide bond, for instance the method is adopted in which a polyamine or an amino-alcohol is condensed together with the polyol (1) and the polycarboxylic acid (2) when the polyester (ii) is condensation-polymerized. Given as examples of the polyamine and the amino-alcohol may be those exemplified for the aforementioned amines (b1) to (b3) used in the invention (I).

It is preferable that at least each part of the polyesters (i) and (ii) be mutually solved in view of the low temperature fixing ability and the hot offset resistance. Accordingly, it is desirable that the polyester components (i) and (ii) have similar compositions.

The ratio by weight of the polyester (i) to the polyester (ii) is generally 5/95 to 80/20, preferably 5/95 to 30/70, more preferably 5/95 to 25/75 and particularly preferably 7/93 to 20/80 in view of the compatibility of the hot offset resistance with storage stability under heat and with the low temperature fixing ability.

It is desirable that the polyester (ii) have a peak of molecular weight in a range between, generally 1000 and 10000, preferably 1500 and 10000 and more preferably 2000 and 8000 in a chromatogram of gel permeation chromatography (GPC) like in the invention (I). When the peak molecular weight falls in this range, this is advantageous in view of the compatibility of the storage stability under heat with the low temperature fixing ability.

The hydroxyl value and acid value of the polyester (ii) are the same as those in the invention (I).

With regard to the toner binder of the invention (III), the glass transition temperature (Tg), the elastic modulus (G') during storage, the value (Ts−Tη), the value of viscosity and the value (Tη−Tg) are the same as those in the invention (I).

As the toner binder of the invention (III), the following specific examples are given.

① A mixture of a polyester produced by urethane-modifying a condensation-polymerized product of an ethylene oxide (2 mols) addition product of bisphenol A and isophthalic acid by using isophorone diisocyanate, and a condensation-polymerized product of an ethylene oxide (2 mols) addition product of bisphenol A and terephthalic acid.

② A mixture of a polyester produced by urethane-modifying a condensation-polymerized product of an ethylene oxide (2 mols) addition product of bisphenol A/a propylene oxide (2 mols) addition product of bisphenol A and terephthalic acid by using isophorone diisocyanate, and a condensation-polymerized product of an ethylene oxide (2 mols) addition product of bisphenol A/a propylene oxide (2 mols) addition product of bisphenol A and terephthalic acid.

③ A mixture of a polyester produced by urethane-modifying a condensation-polymerized product of an ethylene oxide (2 mols) addition product of bisphenol A and terephthalic acid, and 1,4-butanediol by using isophorone diisocyanate; and a condensation-polymerized product of an ethylene oxide (2 mols) addition product of bisphenol A and terephthalic acid.

④ A mixture of a polyester produced by urethane-modifying a condensation-polymerized product of an ethylene oxide (2 mols) addition product of bisphenol A and terephthalic acid, and an ethylene oxide (2 mols) addition product of bisphenol A by using isophorone diisocyanate; and a condensation-polymerized product of an ethylene oxide (2 mols) addition product of bisphenol A and terephthalic acid.

⑤ A mixture of a polyester produced by urethane-modifying a condensation-polymerized product of an ethylene oxide (2 mols) addition product of bisphenol A and isophthalic acid by using diphenylmethane diisocyanate, and a condensation-polymerized product of an ethylene oxide (2 mols) addition product of bisphenol A and isophthalic acid.

⑥ A mixture of a polyester produced by urethane-modifying a condensation-polymerized product of an ethylene oxide (2 mols) addition product of bisphenol A/a propylene oxide (2 mols) addition product of bisphenol A and terephthalic acid/dodecenylsuccinic acid anhydride by using diphenylmethane diisocyanate, and a condensation-polymerized product of an ethylene oxide (2 mols) addition product of bisphenol A/a propylene oxide (2 mols) addition product of bisphenol A and terephthalic acid.

⑦ A mixture of a polyester produced by urethane-modifying a condensation-polymerized product of an ethylene oxide (2 mols) addition product of bisphenol A and terephthalic acid, and 1,4-butanediol by using toluene diisocyanate; and a condensation-polymerized product of an ethylene oxide (2 mols) addition product of bisphenol A and terephthalic acid.

⑧ A mixture of a polyester produced by urethane-modifying a condensation-polymerized product of an ethylene oxide (2 mols) addition product of bisphenol A and terephthalic acid, and 1,4-butanediol by using hexamethylene diisocyanate; and a condensation-polymerized product of an ethylene oxide (2 mols) addition product of bisphenol A and terephthalic acid.

⑨ A mixture of a polyester produced by urea-modifying a prepolymer, obtained by reacting a condensation-polymerized product of an ethylene oxide (2 mols) addition product of bisphenol A/a propylene oxide (2 mols) addition product of bisphenol A and terephthalic acid with isophorone diisocyanate, by using isophoronediamine; and a condensation-polymerized product of an ethylene oxide (2 mols) addition product of bisphenol A/a propylene oxide (2 mols) addition product of bisphenol A and terephthalic acid.

⑩ A mixture of a polyester produced by urea-modifying a prepolymer, obtained by reacting a condensation-polymerized product of an ethylene oxide (2 mols) addition product of bisphenol A/a propylene oxide (2 mols) addition product of bisphenol A and terephthalic acid with isophorone diisocyanate, by using isophoronediamine; and a condensation-polymerized product of a propylene oxide (2 mols) addition product of bisphenol A and terephthalic acid.

⑪ A mixture of a polyester produced by urea-modifying a prepolymer, obtained by reacting a condensation-polymerized product of an ethylene oxide (2 mols) addition product of bisphenol A and terephthalic acid with isophorone diisocyanate, by using hexamethylenediamine; and a condensation-polymerized product of an ethylene oxide (2 mols) addition product of bisphenol A/a propylene oxide (2 mols) addition product of bisphenol A and terephthalic acid.

⑫ A mixture of a polyester produced by urea-modifying a prepolymer, obtained by reacting a condensation-polymerized product of an ethylene oxide (2 mols) addition product of bisphenol A/a propylene oxide (2 mols) addition product of bisphenol A and terephthalic acid/dodecenylsuccinic acid anhydride with diphenylmethane diisocyanate, by using hexamethylenediamine; and a condensation-polymerized product of an ethylene oxide (2 mols) addition product of bisphenol A/a propylene oxide (2 mols) addition product of bisphenol A and terephthalic acid.

⑬ A mixture of a polyester produced by urea-modifying a prepolymer, obtained by reacting a condensation-polymerized product of an ethylene oxide (2 mols) addition product of bisphenol A and isophthalic acid with toluene diisocyanate, by using hexamethylenediamine; and a condensation-polymerized product of an ethylene oxide (2 mols) addition product of bisphenol A and isophthalic acid.

The toner binder of the present invention may be produced by, for example, the following method.

The polyester (A) having a hydroxyl group is obtained by dehydrating and condensing the polycarboxylic acid (2) and the polyol (1) under heat at 150 to 280° C. in the presence of a well-known esterifying catalyst, e.g., tetrabutoxy titanate or dibutyltin oxide. An operation under reduced pressure is effective to improve the reaction rate in the last stage of the reaction.

The polyester (i) modified by a urethane bond is obtained by reacting the polyisocyanate (C) with the polyester (A) and the polyol (B), which is used as required, at 50 to 140° C. In the reaction, a solvent may be used if necessary. Given as examples of the solvent which can be used are those inactive to the isocyanate (C), such as aromatic solvents (e.g., toluene and xylene); ketones (e.g., acetone, methyl ethyl ketone and methyl isobutyl ketone); esters (e.g., ethyl acetate); amides (e.g., dimethylformamide and dimethylacetamide) and ethers (e.g., tetrahydrofuran).

The polyester prepolymer (a ) having an isocyanate group is obtained by reacting the polyisocyanate (3) with the polyester having a hydroxyl group. In the reaction, a solvent may be used if necessary. Given as examples of the solvent which can be used are those inactive to the isocyanate (3), such as aromatic solvents (e.g., toluene and xylene); ketones (e.g., acetone, methyl ethyl ketone and methyl isobutyl ketone); esters (e.g., ethyl acetate); amides (e.g., dimethylformamide and dimethylacetamide) and ethers (e.g., tetrahydrofuran).

The polyester (i) modified by a urea bond is obtained by reacting the polyester prepolymer (a) with the amines (b) at 50 to 140° C. in the presence of a solvent as required. The solvent which may be used is the same that is used in the production of the polyester prepolymer (a).

The unmodified-polyester (ii) is obtained in the same manner as in the case of the polyester (A) having a hydroxyl group.

The polyester (i) modified by a urea bond is mixed with the unmodified-polyester (ii), for example, by a method ① in which the polyesters (i) and (ii) are dissolved in a solvent, in which these polyesters (i) and (ii) can be dissolved, and mixed, followed by distilling the solvent or by a method ② in which the polyesters (i) and (ii) are melted and mixed using a kneader, e.g., an extruder. If these polyesters (i) and (ii) are mixed at high temperatures, a mutual exchange of these polyesters (i) and (ii) is made by transesterification, leading to impaired low temperature fixing ability and hot offset resistance. The mixing temperature is therefore generally 170° C. or less, preferably 150° C. or less and more preferably 120° C. or less.

To suppress the transesterification, a well-known ester exchange reaction inhibitor (e.g., alkyl phosphates) may be used.

To distill a solvent easily at low temperatures in the mixing method ① using a solvent, a solvent solution of these polyesters (i) and (ii) is dispersed in water and thereafter the solvent is removed from the water dispersion. In this method, after distilling the solvent, the dispersed material is filtered from water, washed and dried to obtain a toner binder. Given as examples of the solvent which may be used are the same as those usable in the urethane-modifying reaction. The use of a solvent whose boiling point is 100° C. or less is particularly desirable to distill the solvent easily.

The toner binder of the invention (III) may be used not only for the toner of the invention (I) but also for a so-called kneaded and pulverized toner.

The aforementioned various additives such as colorants, releasing agents and charge control agents are dry-blended. The resulting product is melted and kneaded and thereafter pulverized using, for example, a jet mill, followed by performing air separation to obtain a toner with a particle diameter of generally 2 to 20 $\mu$m.

EXAMPLES

The present invention will be explained in more detail by way of examples, which are not intended to be limiting of the present invention, in which all designations of parts indicate parts by weight, unless otherwise noted, The names of raw materials, functions and the name of makers (or trademarks) will be shown in this order as follows with regard to raw materials other than reagents among the raw materials used in the examples.

Cydnine Blue KRO/colorant/Sdnyo Pigment Co., Ltd.

Carbon black/colorant/Mitsubishi Gas Chemical Co., Inc., MA100

10% Hydroxyapatite suspension/dispersant/Nippon Chemical Industries, Ltd. Supertite 10

Colloidal silica/fluidization agent/Japan Aerosil Co., Ltd. Aerosil R972

Montan wax/releasing agent/Hoechst Japan, WE-40

Example I-1

Synthesis of a Toner Binder

A reaction vessel equipped with a tubular cooler, a stirrer and a nitrogen introducing tube was charged with 343 parts of an ethylene oxide (2 mols) addition product of bisphenol A, 166 parts of isophthalic acid and 2 parts of dibutyltin oxide and the mixture was reacted at 230° C. under normal pressure for 8 hours and further under a vacuum of 10 to 15 mmHg for 5 hours. The reaction mixture was cooled to 110° C. To the reaction mixture was added 17 parts of isophorone diisocyanate and the resulting mixture was reacted at 110° C. for 5 hours, followed by removing the solvent to obtain a urethane-modified polyester (i-1) having a weight average molecular weight of 72000.

570 parts of an ethylene oxide (2 mols) addition product of bisphenol A and 217 parts of terephthalic acid were condensation-polymerized at 230° C. for 6 hours under normal pressure in the same manner as above to obtain an unmodified-polyester (ii-1) having a GPC peak molecular weight of 2400, a hydroxyl value of 51 and an acid value of 5.

200 parts of the urethane-modified polyester (i-1) and 800 parts of the unmodified-polyester (ii-1) were dissolved in 2000 parts of ethyl acetate and mixed to obtain an ethyl acetate solution of a toner binder (TB1).

A part of the ethyl acetate solution was dried under reduced pressure to isolate the toner binder (TB1). The Tg, Tη which may be blocked and Ts of the toner binder were 55° C., 128° C. and 140° C. respectively.

Production of a Toner

A beaker was charged with 240 parts of the ethyl acetate solution of the toner binder (TB1), 20 parts of trimethylolpropane tribehenate (melting point: 58° C., molten viscosity: 24 cps) as a releasing agent and 4 parts of Cyanine Blue KRO. The mixture was stirred at 50° C. at 12000 rpm by using a TK-type homomixer to dissolve and disperse the mixture uniformly, thereby preparing a toner material solution.

Another beaker was charged with 706 parts of ion exchange water, 294 parts of a 10% hydroxyapatite suspension and 0.2 parts of sodium dodecylbenzene sulfonate and the mixture was uniformly dissolved. The temperature was raised to 50° C. and the above toner material solution was added to the mixed solution while stirring at 12000 rpm by using a TK-type homomixer and the stirring was further continued for 10 minutes. The mixture solution was then poured into a flask equipped with a poker and a temperature gage and raised to 98° C. to remove the solvent, followed by filtering, washing and drying. The resulting product was then subjected to air separation to obtain toner particles whose particle diameter (d50) was 6 μm. Then, 0.5 parts of colloidal silica was mixed with 100 parts of the toner particles in a sample mill to obtain a toner (T-I1) according to the present invention. The practical sphericity of the toner particles was 0.98. The results of evaluation are shown in Table 1.

Example I-2

Synthesis of a Toner Binder

The same procedures as in Example I-1 were carried out, except that the isocyanate was altered to 14 parts of toluene diisocyanate and the urethane-modifying temperature was changed to 80° C., to obtain a urethane-modified polyester (i-2) having a weight average molecular weight of 98000.

363 parts of an ethylene oxide (2 mols) addition product of bisphenol A and 166 parts of isophthalic acid are condensation-polymerized in the same manner as in Example I-1 to obtain an unmodified-polyester (ii-2) having a peak molecular weight of 4300, a hydroxyl value of 25 and an acid value of 7.

250 parts.of the urethane-modified polyester (i-2) and 750 parts of the unmodified-polyester (ii-2) were dissolved in 2000 parts of ethyl acetate and mixed to obtain an ethyl acetate solution of a toner binder (TB2).

A part of the acetate solution was dried under reduced pressure to isolate the toner binder (TB2). The Tg, Tη and Ts of the toner binder were 56° C., 135° C. and 152° C. respectively.

Production of a Toner

The same procedures as in Example I-1 were carried out, except that the releasing agent was altered to pentaerythritol tetrabehenate (melting point: 81° C., molten viscosity: 25 cps) and the dissolving temperature and the dispersion temperature were altered to 60° C., to obtain a toner (T-I2) whose particle diameter (d50) was 6 μm. The practical sphericity of the toner particles was 0.97. The results of evaluation are shown in Table 1.

Example I-3

Synthesis of a Toner Binder

A reaction vessel equipped with a tubular cooler, a stirrer and a nitrogen introducing tube was charged with 724 parts of an ethylene oxide (2 mols) addition product of bisphenol A, 276 parts of isophthalic acid and 2 parts of dibutyltin oxide and the mixture was reacted at 230° C. under normal pressure for 8 hours and further under a vacuum of 10 to 15 mmHg for 5 hours. The reaction mixture was cooled to 160° C. To the reaction mixture was added 32 parts of phthalic acid anhydride and the resulting mixture was reacted for 2 hours. The resulting mixture was cooled to 80° C. and reacted with 188 parts of isophorone diisocyanate in ethyl acetate for 2 hours to obtain an isocyanate-containing prepolymer (α1).

Then 267 parts of the prepolymer (α1) was reacted with 14 parts of isophoronediamine at 50° C. for 2 hours to obtain a urea-modified polyester (i-3) having a weight average molecular weight of 64000.

724 parts of an ethylene oxide (2 mols) addition product of bisphenol A, 138 parts of terephthalic acid and 138 parts of isophthalic acid were condensation-polymerized at 230° C. for 6 hours under normal pressure and further under a vacuum of 10 to 15 mmHg for 5 hours in the same manner as above to obtain an unmodified-polyester (ii-3) having a peak molecular weight of 2300, a hydroxyl value of 55 and an acid value of 1.

200 parts of the urea-modified polyester (i-3) and 800 parts of the unmodified-polyester (ii-3) were dissolved in 2000 parts of a mixture solvent of ethyl acetate/MEK (1/1) and mixed to obtain an ethyl acetate/MEK solution of a toner binder (TB3).

A part of the solution was dried under reduced pressure to isolate the toner binder (TB3). The Tg, Tη and Ts of the toner binder were 52° C., 123° C. and 132° C. respectively.

Production of a Toner

The ethyl acetate/MEK solution of the toner binder (TB3) was made into a toner in the same manner as in Example I-2.

Thus a toner (T-I3) whose particle diameter (d50) was 6 μm was obtained. The practical sphericity of the toner particles was 0.96. The results of evaluation are shown in Table 1.

Example I-4

Synthesis of a Toner Binder 669 parts of an ethylene oxide (2 mols) addition product of bisphenol A, 274 parts of isophthalic acid and 20 parts of trimellitic acid anhydride were condensation-polymerized and the polymerized product was reacted with 154 parts of isophorone diisocyanate in the same manner as in Example I-3 to obtain a hydroxyl group-containing prepolymer (α2).

Then 213 parts of the prepolymer (α2) was reacted with 9.5 parts of isophoronediamine and 0.5 parts of dibutylamine in the same manner as in Example I-3 to obtain a urea-modified polyester (i-4) having a weight average molecular weight of 79000.

200 parts of the urea-modified polyester (i-4) and 800 parts of the unmodified-polyester (ii-3) prepared in Example I-3 were dissolved in 2000 parts of a mixture solvent of ethyl acetate/MEK (1/1) and mixed to obtain an ethyl acetate/MEK solution of a toner binder (TB4).

A part of the solution was dried under reduced pressure to isolate the toner binder (TB4). The Tg, Tη and Ts of the toner binder were 52° C., 129° C. and 151° C. respectively.

Production of Toner

The ethyl acetate/MEK solution of the toner binder (TB4) was made into a toner in the same manner as in Example I-1. Thus a toner (T-I4) whose particle diameter (d50) was 6 μm was obtained. The practical sphericity of the toner particles was 0.97. The results of evaluation are shown in Table 1.

Comparative Example I-1

Synthesis of a Toner Binder 354 parts of an ethylene oxide (2 mols) addition product of bisphenol A and 166 parts of isophthalic acid were condensation-polymerized using 2 parts of dibutyltin oxide as a catalyst to obtain a comparative toner binder (CTB1) having a weight average molecular weight of 8000.

The Tg, Tη and Ts of the comparative toner binder (CTB1) were 57° C., 136° C. and 133° C. respectively.

Production of a Toner

A beaker was charged with 100 parts of the comparative toner binder (CTB1), 200 parts of an ethyl acetate solution and 4 parts of Cyanine Blue KRO and the mixture was stirred at 50° C. at 12000 rpm by using a TK-type homomixer to thereby dissolve and disperse the mixture uniformly. The resulting mixture was made into a toner in the same manner as in Example I-1. Thus a comparative toner (CT-I1) whose particle diameter (d50) was 6 μm was obtained. The practical sphericity of the toner particles was 0.98. The results of evaluation are shown in Table 1.

Examples IV-1 to IV-4 and Comparative Example IV-1

Production of Toners 100 parts of each of the toner binders (TB1) to (TB4) according to the present invention or the comparative toner binder (CTB1), 7 parts of glycerol tribehenate and 4 parts of Cyanine Blue KRO were used to form each toner by using the following method.

Firstly, the raw materials were premixed using a Henshel mixer (FM10B, manufactured by Mitsui Miike Chemical Eng. Machine Co., Ltd.) and thereafter kneaded using a two-shaft kneader (PCM-30, manufacture by Ikegai Corporation). The kneaded mixture was pulverized using a supersonic jet crusher laboratory jet (manufactured by Nippon Pneumatic Industry Ltd.) and then classified using a pneumatic classifier (MDS-I, manufacture by Nippon Pneumatic Industry Ltd.) to obtain toner particles whose particle diameter (d50) was 5 to 20 μm. Next, 0.5 parts of colloidal silica was mixed with 100 parts of the toner particles in a sample mill to obtain toners (T-IV1) to (T-IV4) and a comparative toner (CT-IV1).

The results of evaluation are shown in Table 1.

Example IV-5

Synthesis of a Toner Binder 343 parts of an ethylene oxide (2 mols) addition product of bisphenol A and 166 parts of isophthalic acid are condensation-polymerized in the same manner as in Example I-1. In methyl ethyl ketone, 7 parts of 1,4-butanediol and 34 parts of isophorone diisocyanate were added to the polymerized product and the mixture was reacted at 80° C. for 8 hours to obtain a urethane-modified polyester (i-5) having a weight average molecular weight of 68000.

200 parts of the urethane-modified polyester (i-5) and 800 parts of the unmodified-polyester (ii-2) synthesized in Example I-2 were dissolved in the same manner as in Example I-1, followed by removing the solvent to obtain a toner binder (TB5) according to the present invention. The Tg, Tη and Ts of the toner binder were 55° C., 129° C. and 151° C. respectively.

Production of a Toner

The same procedures as in Example IV-1 were carried out to form a toner (T-IV5). The results of evaluation are shown in Table 1.

Example II-1

Production Example of a Ketimine Compound

A reaction vessel equipped with a poker and a temperature gage was charged with 30 parts of isophoronediamine and 70 parts of methyl ethyl ketone. The mixture was reacted at 50° C. for 5 hours to obtain a ketimine compound (β1).

Production Example of a Toner

A beaker was charged with 15.4 parts of an isocyanate-containing prepolymer (α1), 64 parts of an unmodified-polyester (dead polymer) (ii-3) and 78.6 parts of ethyl acetate and the mixture was stirred to dissolve. Next, 20 parts of pentaerythritol tetrabehenate and 4 parts of Cyanine Blue KRO were added and the resulting mixture was stirred at 60° C. at 12000 rpm by using a TK-type homomixer to dissolve and disperse the mixture uniformly. Finally, 2.7 parts of the ketimine compound (β1) was added and dissolved to prepare a toner material solution (S1).

Another beaker was charged with 706 parts of ion exchange water, 294 parts of a 10% hydroxyapatite suspension and 0.2 parts of sodium dodecylbenzene sulfonate and the mixture was uniformly dissolved. The temperature was raised to 60° C. and the above toner material solution (S1) was added to the mixed solution while stirring at 12000 rpm by using a TK-type homomixer and the stirring was further continued for 10 minutes. The mixture solution was then poured into a flask equipped with a poker and a temperature gage and raised to 98° C. to remove the solvent while progressing a urea-modifying reaction, followed by filtering, washing and drying. The resulting product was then subjected to air separation to obtain toner particles whose particle diameter (d50) was 6 μm. Then, 0.5 parts of colloidal silica was mixed with 100 parts of the toner particles in a sample mill to obtain a toner (T-II1) according to the present invention.

The weight average molecular weight, number average molecular weight and glass transition temperature (Tg) of a toner binder component contained in the toner (T-II1) were 14000, 2000 and 52° C. The results of evaluation are shown in Table 1.

Example II-2

Production Example of a Toner

A beaker was charged with 15.5 parts of a prepolymer (α2), 64 parts of a dead polymer (ii-3) and 78.8 parts of ethyl acetate and the mixture was stirred to dissolve. Next, 20 parts of trimethylolpropane tribehenate and 4 parts of Cyanine Blue KRO were added and the resulting mixture was stirred at 50° C. at 12000 rpm by using a TK-type homomixer to dissolve and disperse the mixture uniformly. Finally, 2.4 parts of the ketimine compound (β1) and 0.036 parts of dibutylamine were added and dissolved to prepare a toner material solution (S2).

The same procedures as in Example II-1 were carried out, except that the toner material solution (S2) was used and the dispersion temperature was altered to 50° C., to run toner formation, thereby obtaining a toner (T-II2) whose particle diameter d50 was 6 μm according to the present invention.

The weight average molecular weight, number average molecular weight and glass transition temperature (Tg) of a toner binder component contained in the toner (T-II2) were 18000, 2000 and 52° C. The results of evaluation are shown in Table 1.

Example II-3

Production Example of a Prepolymer

A reaction vessel equipped with a tubular cooler, a stirrer and a nitrogen introducing tube was charged with 724 parts of an ethylene oxide (2 mols) addition product of bisphenol A, 276 parts of isophthalic acid and 2 parts of dibutyltin oxide and the mixture was reacted at 230° C. under normal pressure for 8 hours and further under a vacuum of 10 to 15 mmHg for 5 hours. The reaction mixture was cooled to 160° C. To the reaction mixture was added 32 parts of phthalic acid anhydride and the resulting mixture was reacted for 2 hours. Then, the reaction mixture was cooled to 80° C. and further reacted with 188 parts of isophorone diisocyanate in toluene for 2 hours to obtain an isocyanate group-containing prepolymer (α3) having a weight average molecular weight of 13000.

Production Example of a Dead Polymer 654 parts of an ethylene oxide (2 mols) addition product of bisphenol A and 516 parts of dimethyl terephthalate were condensation-polymerized at 230° C. under normal pressure for 6 hours and then under a vacuum of 10 to 15 mmHg for 5 hours with dehydration to obtain a dead polymer (ii-4) having a peak molecular weight of 2400 and a hydroxyl value of 2.

Production Example of a Toner

A beaker was charged with 15.4 parts of the prepolymer (α3), 64 parts of the dead polymer (ii-4), 40 parts of toluene and 40 parts of methyl ethyl ketone (MEK) and the mixture was stirred to dissolve. Then 20 parts of pentaerythritol tetrabehenate and 4 parts of Cyanine Blue KRO were added and the mixture was stirred at 60° C. at 12000 rpm by using a TK-type homomixer to dissolve and disperse the mixture uniformly. Finally, 0.33 parts of 1,4-butanediol was added as an extension agent to and dissolved in the mixture to prepare a toner material solution (S3).

The toner material solution (S3) was made into a toner with a urethane-modifying reaction in the same manner as in Example II-1. Thus a toner (T-II3) whose particle diameter d50 was 6 μm according to the present invention was obtained. The weight average molecular weight, number average molecular weight and glass transition temperature (Tg) of a toner binder component contained in the toner (T-II3) were 11000, 2000 and 52° C. The results of evaluation are shown in Table 1.

Example II-4

Production Example of a Prepolymer

In the same manner as in Example II-3, 669 parts of an ethylene oxide (2 mols) addition product of bisphenol A, 274 parts of isophthalic acid and 20 parts of trimellitic acid anhydride were condensation-polymerized and thereafter 154 parts of isophorone diisocyanate was reacted with the polymerized product to obtain an isocyanate group-containing prepolymer (a4) having a weight average molecular weight of 15000.

Production Example of a Toner

A beaker was charged with 15.5 parts of the prepolymer (a4), 64 parts of the dead polymer (ii-4), 40 parts of toluene and 40 parts of MEK and stirred to dissolve. Then 20 parts of trimethylolpropane tribehenate and 4 parts of Cyanine Blue KRO were added and the mixture was stirred at 50° C. at 12000 rpm by using a TK-type homomixer to dissolve and disperse the mixture uniformly. Finally, 1.1 parts of an ethylene oxide (2 mols) addition product of bisphenol A was added as an extension agent to and dissolved in the mixture to prepare a toner material solution (S4).

A toner-forming process was carried out in same manner as in Example II-3, except that the toner material solution (S4) was used and the dispersing temperature was altered to 50° C., to obtain a toner (T-II4) whose particle diameter d50 was 6 μm according to the present invention.

The weight average molecular weight, number average molecular weight and glass transition temperature (Tg) of a toner binder component contained in the toner (T-II4) were 14000, 2000 and 52° C. The results of evaluation are shown in Table 1.

Example II-5

Production Example of a Prepolymer

A reaction vessel equipped with a tubular cooler, a stirrer and a nitrogen introducing tube was charged with 360 parts of an ethylene oxide (2 mols) addition product of bisphenol A, 166 parts of isophthalic acid and 2 parts of dibutyltin oxide and the mixture was reacted at 230° C. under normal pressure for 8 hours and further under a vacuum of 10 to 15 mmHg for 5 hours. The reaction mixture was cooled to 160° C. to obtain a hydroxyl group-containing prepolymer (α5) having a weight average molecular weight of 9000.

Production Example of a Toner

A beaker was charged with 15.3 parts of the prepolymer (α5), 63.6 parts of the dead polymer (ii-4), 40 parts of toluene and 40 parts of ethyl acetate and the mixture was stirred to dissolve. Then 20 parts of pentaerythritol tetrabehenate and 4 parts of Cyanine Blue KRO were added and the mixture was stirred at 60° C. at 12000 rpm by using a TK-type homomixer to dissolve and disperse the mixture uniformly. Finally, 1.1 parts of diphenylmethane diisocyanate was added as an extension agent to and dissolved in the mixture to prepare a toner material solution (S5). The toner material solution (S5) was treated in a toner-forming process in the same manner as in Example II-3 to obtain a toner (T-II5) whose particle diameter d50 was 6 μm according to the present invention.

The weight average molecular weight, number average molecular weight and glass transition temperature (Tg) of a toner binder component contained in the toner (T-II5) were 16000, 2100 and 52° C. The results of evaluation are shown in Table 1.

Example II-6

Production Example of a Prepolymer

In the same manner as in Example II-5, 392 parts of an ethylene oxide (2 mols) addition product of bisphenol A, 166 parts of isophthalic acid and 13 parts of trimellitic acid anhydride were condensation-polymerized to obtain a hydroxyl group-containing prepolymer (α6) having a weight average molecular weight of 15000.

Production Example of a Toner

A beaker was charged with 15.4 parts of the prepolymer (α6), 63.7 parts of the dead polymer (ii-4), 40 parts of toluene and 40 parts of ethyl acetate and the mixture was stirred to dissolve. Then 20 parts of trimethylolpropane tribehenate and 4 parts of Cyanine Blue KRO were added and the mixture was stirred at 50° C. at 12000 rpm by using a TK-type homomixer to dissolve and disperse the mixture uniformly. Finally, 2.1 parts of a reaction product of diphenylmethane diisocyanate and 1,4-butanediol (2:1) was added as an extension agent to and dissolved in the mixture to prepare a toner material solution (S6).

A toner-forming process was carried out in the same manner as in Example II-5, except that the toner material solution (S6) was used and the dispersing temperature was altered to 50° C., to obtain a toner (T-II6) whose particle diameter d50 was 6 μm according to the present invention.

The weight average molecular weight, number average molecular weight and glass transition temperature (Tg) of a toner binder component contained in the toner (T-II6) were 21000, 2200 and 52° C. The results of evaluation are shown in Table 1.

TABLE 1

| Toner No. | Powder fluidity | Storage stability under heat (%) | GLOSS (° C.) | HOT (° C.) |
|---|---|---|---|---|
| (T-I1) | 0.39 | 13 | 135 | 170 |
| (T-I2) | 0.41 | 9 | 145 | 200 |
| (T-I3) | 0.38 | 20 | 130 | 180 |
| (T-I4) | 0.37 | 19 | 150 | ≧23O |
| (CT-I1) | 0.35 | 21 | 150 | 160 |
| (T-IV1) | 0.28 | 31 | 135 | 165 |
| (T-IV2) | 0.27 | 29 | 145 | 190 |
| (T-IV3) | 0.27 | 33 | 130 | 180 |
| (T-IV4) | 0.29 | 30 | 150 | ≧230 |
| (T-IV5) | 0.29 | 30 | 140 | 190 |
| (CT-IV1) | 0.27 | 28 | 150 | 160 |
| (T-II1) | 0.37 | 19 | 130 | 185 |
| (T-II2) | 0.36 | 17 | 150 | ≧230 |
| (T-II3) | 0.38 | 20 | 130 | 170 |
| (T-II4) | 0.39 | 18 | 150 | 200 |
| (T-II5) | 0.36 | 20 | 130 | 180 |
| (T-II6) | 0.34 | 16 | 155 | 220 |

Method of Evaluation (1) Powder fluidity

A powder tester manufactured by Hosokawa Micron Co., Ltd. was used to measure the static apparent density. The better the fluidity of the toner is, the larger the static apparent density is.

(2) Storage Stability Under Heat

The toner was put through 42 mesh sieve for 2 minutes after it was stored at 50° C. for 8 hours to measure the ratio of a toner residue left on the sieve, the ratio being defined as the storage stability under heat. The better the storage stability under heat is, the smaller the residual ratio is.

(3) Glossiness-Developing Temperature (GLOSS)

An oil supply unit was excluded from a fixing apparatus of a commercially available color copying machine (CLC-1, manufactured by Canon Inc.). The modified copying machine in which oil on a fixing roll was removed was used to fix for evaluation. The fixing roll temperature at which the 60 degree glossiness of the fixed image was 10% or more was adopted as the glossiness-developing temperature.

(4) Hot Offset Generation Temperature (HOT)

An evaluation by fixing was made like in the above GLOSS to determine whether or not a hot offset to the fixed image was present by visual observation. The fixing roll temperature at which an hot offset occurred was adopted as the hot offset generation temperature.

Example I-5

Synthesis of a Toner Binder 350 parts of the urethane-modified polyester (i-2) and 650 parts of the unmodified polyester (ii-2) were dissolved in and mixed with 3000 parts of ethyl acetate to obtain an ethyl acetate solution of a toner binder (TB6).

A part of the resulting solution was dried under reduced pressure to isolate the toner binder (TB6). The Tg, Tη and Ts of the toner binder were 58° C., 145° C. and 170° C. respectively.

Production of a Toner

The same procedures as in Example I-2 were carried out, except that 300 parts of the ethyl acetate solution of the toner binder (TB6), 5 parts of a montan wax and 8 parts of carbon black were used as the toner materials, to obtain a toner (T-I5) whose particle diameter d50 was 6 μm according to the present invention. The practical sphericity of the. toner particles was 0.97. The results of evaluation are shown in Table 2.

Example I-6

Production of Toner

The toner binder (TB4) was treated in a toner-forming process in the same manner as in Example I-4, except that the colorant was altered to 8 parts of carbon black, to obtain a toner (T-I6) whose particle diameter d50 was 6 μm according to the present invention. The practical sphericity of the toner particles was 0.96. The results of evaluation are shown in Table 2.

Example I-7

Synthesis of a Toner Binder 300 parts of the urea-modified polyester (i-4) and 700 parts of the unmodified polyester (ii-2) were dissolved in and mixed with 3000 parts of ethyl acetate/MEK (1:1) to obtain an ethyl acetate/MEK solution of a toner binder (TB7).

A part of the resulting solution was dried under reduced pressure to isolate the toner binder (TB7). The Tg, Tη and Ts of the toner binder were 57° C., 143° C. and 172° C. respectively.

Production of a Toner

The same procedures as in Example I-1 were carried out, except that 300 parts of the ethyl acetate/MEK solution of the toner binder (TB7), 5 parts of a montan wax and 8 parts of carbon black were used as the toner materials, to obtain a toner (T-I7) whose particle diameter d50 was 6 μm according to the present invention. The practical sphericity of the toner particles was 0.95. The results of evaluation are shown in Table 2.

Examples IV-6 and IV-7

Synthesis of a Toner Binder 300 parts of the urethane-modified polyester (i-5) and 700 parts of the unmodified polyester (ii-2) were dissolved and thereafter the solvent was removed in the same manner as in Example I-1 to obtain a toner binder (TB8).

The Tg, Tη and Ts of the toner binder were 57° C., 1440° C. and 165° C. respectively.

300 parts of the urea-modified polyester (i-4) and 700 parts of the unmodified polyester (ii-2) were mixed in the same manner as in Example I-3 to obtain a toner binder (TB9). The Tg, Tη and Ts of the toner binder were 57° C., 143° C. and 172° C. respectively.

Production of a Toner

The toner binders (TB8) and (TB9) were treated in the same toner-forming process as in Example IV-1, except that 5 parts of montan wax and 8 parts of carbon black were used as the releasing agent and the colorant respectively, to obtain Toners (T-IV6) and (T-IV7)

The results of evaluation are shown in Table 2.

Example II-7

Production Example of a Toner

A toner (T-II7) having a particle diameter d50 of 6 μm according to the present invention was obtained in the same manner as in Example II-2 except that 8 parts of carbon black was used as the colorant. The results of evaluation are shown in Table 2.

Example II-8

Production Example of a Toner

A beaker was charged with 28.8 parts of the prepolymer (α4), 69.2 parts of the unmodified polyester (dead polymer) (ii-2) and 99 parts of ethyl acetate and the mixture was stirred to dissolve. Next, 5 parts of a montan wax and 8 parts of carbon black were added and the resulting mixture was stirred at 50° C. at 12000 rpm by using a TK-type homomixer to dissolve and disperse the mixture uniformly. Finally, 4.4 parts of the ketimine compound (β1) and 0.068 parts of dibutylamine were added and dissolved to prepare a toner material solution (S8).

The same procedures as in Example II-1 were carried out, except that the toner material solution (S8) was used, to run toner formation, thereby obtaining a toner (T-II8) whose particle diameter d50 was 6 μm according to the present invention.

The weight average molecular weight, number average molecular weight and glass transition temperature (Tg) of a toner binder component contained in the toner (T-II8) were 28000, 4300 and 57° C. The results of evaluation are shown in Table 2.

Example II-9

Production Example of a Toner

A beaker was charged with 15.5 parts of the prepolymer (α4), 64 parts of the dead polymer (ii-4) and 80 parts of ethyl acetate and the mixture was stirred to dissolve. Next, 20 parts of trimethylolpropane tribehenate and 8 parts of carbon black were added and the resulting mixture was stirred at 50° C. at 12000 rpm by using a TK-type homomixer to dissolve and disperse the mixture uniformly to prepare a toner material solution (S9).

The same procedures as in Example II-3 were carried out, except that the toner material solution (S9) was used and the dispersing temperature was altered to 50° C., to run toner formation accompanied by an extension reaction using only water, thereby obtaining a toner (T-II9) whose particle diameter d50 was 6 μm according to the present invention.

The weight average molecular weight, number average molecular weight and glass transition temperature (Tg) of a toner binder component contained in the toner (T-II9) were 16000, 2000 and 52°C. The results of evaluation are shown in Table 2.

Example II-10

Production Example of a Dead Polymer 327 parts of an ethylene oxide (2 mols) addition product of bisphenol A and 213 parts of dimethyl isophthalate were condensation-polymerized in the same manner as in Example II-3 to obtain a dead polymer (ii-5) having a peak molecular weight of 4200 and a hydroxyl value of 3.

Production Example of a Toner

A beaker was charged with 28.8 parts of the prepolymer (α4), 69.2 parts of the dead polymer (ii-5), 50 parts of toluene and 50 parts of MEK and the mixture was stirred to dissolve. Then 5 parts of a montan wax and 8 parts of carbon black were added and the mixture was stirred at 50° C. at 12000 rpm by using a TK-type homomixer to dissolve and disperse the mixture uniformly. Finally, 0.54 parts of 1,4-butanediol was added as an extension agent to and dissolved in the mixture to prepare a toner material solution (S10).

The same toner-forming process as in Example II-3 was carried out, except that the toner material solution (S10) was used, to obtain a toner (T-II10) whose particle diameter d50 was 6 μm according to the present invention.

The weight average molecular weight, number average molecular weight and glass transition temperature (Tg) of a toner binder component contained in the toner (T-II10) were 23000, 4200 and 56° C. The results of evaluation are shown in Table 2.

Example II-11

Production Example of a Toner

The same toner-forming process as in Example II-6 was carried out, except that 8 parts of carbon black was used as the colorant, to obtain a toner (T-II11) whose particle diameter d50 was 6 μm. The results of evaluation are shown in Table 2.

Example II-12

Production Example of a Toner

A beaker was charged with 28.8 parts of the prepolymer (α6), 69.5 parts of the dead polymer (ii-5), 50 parts of toluene and 50 parts of ethyl acetate and the mixture was stirred to dissolve. Then 5 parts of a montan wax and 8 parts of carbon black were added and the mixture was stirred at 60° C. at 12000 rpm by using a TK-type homomixer to dissolve and disperse the mixture uniformly. Finally, 1.7 parts of diphenylmethane diisocyanate was added as an extension agent to and dissolved in the mixture to prepare a toner material solution (S12).

The same toner-forming process as in Example II-5 was carried out, except that the toner material solution (S12) was used, to obtain a toner (T-II12) whose particle diameter d5O was 6 μm according to the present invention.

The weight average molecular weight, number average molecular weight and glass transition temperature (Tg) of a toner binder component contained in the toner (T-II12) were 34000, 4400 and 57° C. The results of evaluation are shown in Table 2.

TABLE 2

| Toner No. | Powder fluidity | Storage stability under heat (%) | MFT (° C.) | HOT (° C.) |
|---|---|---|---|---|
| (T-I5) | 0.36 | 6 | 130 | ≧230 |
| (T-I6) | 0.37 | 18 | 110 | 230 |
| (T-I7) | 0.35 | 8 | 130 | ≧230 |
| (T-IV6) | 0.27 | 31 | 125 | ≧230 |
| (T-IV7) | 0.28 | 27 | 130 | ≧230 |
| (T-II7) | 0.36 | 17 | 115 | 230 |
| (T-II8) | 0.34 | 9 | 125 | ≧230 |
| (T-II9) | 0.37 | 16 | 115 | 220 |
| (T-II10) | 0.39 | 12 | 120 | 230 |
| (T-II11) | 0.37 | 18 | 115 | 220 |
| (T-II12) | 0.35 | 8 | 125 | 230 |

Method of Evaluation (1) Powder Fluidity

A powder tester manufactured by Hosokawa Micron Co., Ltd. was used to measure the static apparent density. The better the fluidity of the toner is, the larger the static apparent density is.

(2) Storage Stability Under Heat

The toner was put through 42 mesh sieve for 2 minutes after it was stored at 50° C. for 8 hours to measure the ratio of a toner residue left on the sieve, the ratio being defined as the storage stability under heat. The better the storage stability under heat is, the smaller the residual ratio of the toner is.

(3) Minimum Fixing Temperature (MFT)

A commercially available black-and-white copying machine (SF8400A, manufactured by Sharp Corporation) was used to fix for evaluation. The fixing roll temperature at which the residual rate of the image density, after the fixed image was rubbed by a pat, was 70% or more was adopted as the fixed roll temperature.

(4) Hot Offset Generation Temperature (HOT)

An evaluation by fixing was made like in the above MFT to determine whether or not a hot offset to the fixed image was present by visual observation. The fixing roll temperature at which an hot offset occurred was adopted as the hot offset generation temperature.

INDUSTRIAL APPLICABILITY

As stated above, the toner and toner binder of the present invention are suitable for the purpose intended to form a high quality image by using printers or copying machines.

What is claimed is:

1. A toner comprising a toner binder and a colorant, wherein the toner is in the form of particles having a Wadell practical sphericity of 0.95 to 1.00 and the toner binder comprises a polyester (i) modified with a urethane bond and/or a urea bond.

2. A toner according to claim 1, including a polyester (ii), which is modified neither by a urethane bond nor by a urea bond together with the modified polyester (i), wherein the ratio by weight of the polyester (i) to the polyester (ii) is 5/95 to 80/20.

3. A toner according to claim 2, wherein the unmodified polyester (ii) has a peak molecular weight of 1000 to 10000 in a chromatogram of gel permeation chromatography (GPC) and a hydroxyl value of 5 or more.

4. A toner comprising a toner binder and a colorant, wherein the toner is in the form of particles having a Wadell practical sphericity of 0.90 to 1.00 and the toner binder comprises a polyester (i) modified with a urea bond with or without a urethane bond, the ratio of the urea bond to the urethane bond in the modified polyester (i) being from 10/0 to 1/9.

5. A toner according to claim 1, wherein the toner particles are formed in an aqueous medium.

6. A toner comprising a toner binder and a colorant, wherein the toner binder comprises resin particles produced by causing an extension reaction and/or crosslinking reaction of a dispersion formed of a reactive group-containing prepolymer (α) contained in an aqueous medium by using an extender and/or a crosslinking agent (β).

7. A toner according to claim 6, wherein the extension reaction and/or the crosslinking reaction is performed in the presence of a colorant.

8. A toner according to claim 6, wherein the reactive group contained in the prepolymer (α) is a functional group (α1) reactive with an active hydrogen compound and the crosslinking agent (β) is a compound (β1) having active hydrogen.

9. A toner according to claim 8, wherein the compound (β1) is at least one compound selected from the group consisting of polyamines (β1a) which may be blocked, polyols (β1b), polymercaptans (β1c), and water (β1d).

10. A toner according to claim 9, wherein the polyamines (β1a) are ketimine compounds.

11. A toner according to claim 6, wherein the reactive group contained in the prepolymer (α) is an active hydrogen-containing group and the crosslinking agent (β) is at least one compound selected from the group consisting of polyisocyanates (β2a), polyepoxides (β2b), polycarboxylic acids (β2c), polyacid anhydrides (β2d) and polyacid halides (β2e).

12. A toner according to claim 11, wherein the active hydrogen-containing group contained in the prepolymer (α) is a functional group selected from the group consisting of an amino group which may be blocked, a hydroxyl group, a mercapto group and a carboxyl group.

13. A toner according to claim 6, wherein the prepolymer (α) is selected from the group consisting of a polyester prepolymer (αx), an epoxy resin prepolymer (αy) and a polyurethane polymer (αz).

14. A toner according to claim 6, wherein the prepolymer (α) has a melt viscosity of 2000 poises or less at 100° C.

15. A toner according to claim 6, wherein the toner binder is composed of a resin (I) produced from the prepolymer (α) by an extension reaction and/or a crosslinking reaction in an aqueous medium and a resin (II) which is processed neither by an extension reaction nor by a crosslinking reaction, wherein the ratio of the resin (I) to the resin (II) is 5/95 to 80/20.

16. A toner according to claim 1, wherein the glass transition temperature (Tg) of the toner binder is 35 to 85° C. and the difference between the temperature (Ts) at which the elastic modulus of the toner binder at a measuring frequency of 20 Hz is 10000 dyne/cm$^2$ and the temperature (Tη) at which the viscosity of the toner binder is 1000 poises, namely (Ts−Tη) is 0° C. or more.

17. A toner according to claim 1, wherein the difference between the temperature (Tη) at which the viscosity of the toner binder is 1000 poises and the glass transition temperature (Tg) of the toner binder, namely (Tη−Tg) is 10° C. or less.

18. A toner according to claim 1, wherein the colorant is composed of dyes and/or pigments of a color selected from the group consisting of a cyan color, a magenta color and a yellow color.

19. A toner according to claim 1, the toner including 3–30% by weight of a wax which has a melting point of 50 to 120° C. and a molten viscosity of 5 to 1000 cps at a temperature 20° C. higher than the melting point.

20. A toner binder polyesters derived from a polyol (1) and a polycarboxylic acid (2), wherein the polyesters comprise a polyester (i) modified with a urea bond and a polyester (ii) modified neither with a urethane bond nor with a urea bond.

21. A toner binder according to claim 20, the ratio by weight of the polyester (i) to the polyester (ii) is 5/95 to 80/20.

22. A toner binder comprising polyesters derived from a polyol (1) and a polycarboxylic acid (2), wherein the polyesters comprise a polyester (i) modified with a urethane bond and/or a urea bond and an unmodified polyester (ii) free from any urethane bond and any urea bond, the unmodified polyester (ii) having a peak molecular weight of 1000 to 10000 in a chromatogram of gel permeation chromatography (GPC) and a hydroxyl value of 5 or more.

23. A toner binder according to claim 20, wherein the ratio of the urea bond to the urethane bond in the modified polyester (i) is 10/0 to 1/9.

24. A toner binder according to claim 20, wherein the modified polyester (i) is a polyester (i-a) which is modified by a urethane bond and is derived from a polyester (A) having a hydroxyl group, a polyol (B) and a polyisocyanate (3), the ratio of the polyester (A) to the polyol (B) being 1/0 to 1/5 in terms of equivalent ratio $[OH_A]/[OH_B]$ of a hydroxyl group $[OH_A]$ contained in the polyester (A) to a hydroxyl group $[OH_B]$ contained in the polyol (B).

25. A toner binder according to claim 20, wherein the glass transition temperature (Tg) of the toner binder is 35 to 85° C. and the difference between the temperature (Ts) at which the elastic modulus of the toner binder at a measuring frequency of 20 Hz is 100000 dyne/cm$^2$ and the temperature (Tη) at which the viscosity of the toner binder is 1000 poises, namely (Ts−Tη) is 0° C. or more.

26. A toner binder according to claim 20, wherein the difference between the temperature (Tη) at which the viscosity of the toner binder is 1000 poises and the glass transition temperature (Tg) of the toner binder, namely (Tη−Tg) is 10° C. or less.

27. A toner comprising a toner binder according to claim 20 and a colorant.

28. A toner comprising a toner binder according to claim 22 and a colorant.

* * * * *

UNITED STATES PATENT AND TRADEMARK OFFICE

CERTIFICATE OF CORRECTION

PATENT NO. : 6,326,115 B1
DATED : December 4, 2001
INVENTOR(S) : Hideo Nakanishi et al.

It is certified that error appears in the above-identified patent and that said Letters Patent is hereby corrected as shown below:

Column 34,
Line 38, “bond together” should read -- bond, together --.

Signed and Sealed this

Ninth Day of March, 2004

JON W. DUDAS
*Acting Director of the United States Patent and Trademark Office*